US012129678B2

(12) United States Patent
De Frene et al.

(10) Patent No.: US 12,129,678 B2
(45) Date of Patent: Oct. 29, 2024

(54) TERRACE CANOPY

(71) Applicant: RENSON SUNPROTECTION-SCREENS, Waregem (BE)

(72) Inventors: Joost De Frene, Waregem (BE); Kristof Lemiegre, Gentbrugge (BE); Lennart De Meulemeester, Ledeberg (BE); Pieter Brabant, Rumbeke (BE); Thomas De Rycke, Ghent (BE)

(73) Assignee: RENSON SUNPROTECTION-SCREENS (BE)

( * ) Notice: Subject to any disclaimer, the term of this patent is extended or adjusted under 35 U.S.C. 154(b) by 196 days.

(21) Appl. No.: 17/919,840

(22) PCT Filed: Apr. 21, 2021

(86) PCT No.: PCT/IB2021/053274
§ 371 (c)(1),
(2) Date: Oct. 19, 2022

(87) PCT Pub. No.: WO2021/214672
PCT Pub. Date: Oct. 28, 2021

(65) Prior Publication Data

US 2023/0151635 A1 May 18, 2023

(30) Foreign Application Priority Data

Apr. 21, 2020 (BE) ..... 2020/5263

(51) Int. Cl.
*E04H 15/34* (2006.01)

(52) U.S. Cl.
CPC ..... *E04H 15/34* (2013.01)

(58) Field of Classification Search
CPC ..... E04C 3/07; E04C 2003/0413; E04C 2003/0439; E04C 2003/0465;
(Continued)

(56) References Cited

U.S. PATENT DOCUMENTS 6,446,394 B1 * 9/2002 Finke ..... E05D 15/0652 49/404
2016/0298332 A1 * 10/2016 Veys ..... E04C 3/32
(Continued)

FOREIGN PATENT DOCUMENTS

BE 1021793 B1 1/2016
FR 3049976 A1 10/2017
(Continued)

OTHER PUBLICATIONS

International Search Report and Written Opinion for PCT Application No. PCT/IB2021/053274, dated Aug. 10, 2021, pp. 1-14.
(Continued)

*Primary Examiner* — Gisele D Ford
(74) *Attorney, Agent, or Firm* — Dickinson Wright PLLC

(57) ABSTRACT

Disclosed is a terrace canopy comprising a beam which is constructed from a set of profiles. The set includes a beam profile provided to serve as a beam of the terrace canopy, in which the beam profile has an upright inner side wall and a first connection means. The set also comprises two mutually different spacer profiles, each of which is attachable to the beam profile via the first connection means. Each spacer profile also has a further connection means to which a beam-finishing profile can be attached, which beam-finishing profiles also form part of the set. The spacer profile determines the distance between the outward facing surface of the beam-finishing profile and the upright wall of the beam profile. Hence, the width of the beam can be varied depending on the type of wall infill.

20 Claims, 18 Drawing Sheets

(58) Field of Classification Search
CPC ..... E04D 2013/0893; E04D 13/08; E04D 13/064; E04F 10/0685; E04F 10/02; E04F 10/06; E04H 6/025; E04H 15/34; E04H 15/58; E04B 2001/2409; E04B 2001/2451; E06B 9/42
See application file for complete search history.

(56) References Cited

U.S. PATENT DOCUMENTS

| | | | | |
|---|---|---|---|---|
| 2016/0333587 | A1* | 11/2016 | Veys | E04F 10/0685 |
| 2020/0340299 | A1* | 10/2020 | Snader | E06B 9/42 |
| 2022/0127905 | A1* | 4/2022 | Cortvriendt | E06B 9/42 |

FOREIGN PATENT DOCUMENTS

| | | | |
|---|---|---|---|
| IT | 201800001632 | A1 | 7/2019 |
| WO | 2018087632 | A1 | 5/2018 |

OTHER PUBLICATIONS

International Preliminary Report on Patentability for PCT Application No. PCT/IB2021/053274, dated Jul. 8, 2022, pp. 1-16.

* cited by examiner

TERRACE CANOPY

CROSS-REFERENCE TO RELATED APPLICATION(S)

This present application is a national stage application of International Patent Application No. PCT/IB2021/053274, filed Apr. 21, 2021, which claims priority to Belgium Patent Application No. 2020/5263, filed Apr. 21, 2020, the disclosures of which are hereby incorporated by reference in their entireties.

TECHNICAL FIELD

The present invention relates to a terrace canopy comprising a beam that is constructed from a set of profiles.

STATE OF THE ART

Such terrace canopies are usually set up to screen off or clear an outdoor area. For instance, such screen devices are often set up near houses, restaurants, shops, etc. to screen off an outdoor terrace or the like from sunlight, precipitation and/or wind, or conversely, to temporarily allow in sunlight. These terrace canopies can be implemented, for example, in the form of awnings, pergolas, verandas, carports, a pavilion, etc.

Such a terrace canopy typically comprises a roof frame that is at least partially supported by columns. Exceptionally, the roof frame may also be supported by another roof construction. The roof frame is generally constructed of several beams that are composed into one or more frames into which a roof infill can be attached. The beams themselves are often a composition of a plurality of individual profiles. Such a roof frame is typically supported by four (or more) columns between which a wall infill may be provided. Likewise, less columns may be used in case the roof frame is supported by other structures, such as a wall of an already existing structure.

The roof infill may be stationary or movable, for example, a retractable roof. The roof infill of a retractable roof may, for instance, consist of a rollable cloth or screen, slats that rotate around their axis, or of segments that can slide over each other. The segments may be panels that are partly made of (laminated) glass or plastic, such as PC or PMMA. Depending on the choice of material, the light transmission and robustness of the roof may be adjusted to the desired application. The wall infill can also be stationary or movable. Examples are a rollable cloth or screen or movable, i.e. slidable or foldable, panels.

Furthermore, various types of columns have already been developed that also include other functions in addition to their general support function. For example, the columns may be adapted to also provide supply cables to electrical equipment and/or to include drainage tubes for discharging precipitation and/or to comprise guide profiles for a screen. Preferably, the column should be able to encompass all of the abovementioned functions and also be finished on the outside as aesthetically as possible.

A known problem with such a terrace canopy is the amount of customization and/or the number of standard components that may be required to provide sufficient variation in the construction possibilities of the terrace canopy.

BE 2014/0015 discloses a terrace canopy comprising a beam having a top side, bottom side, inner side and outer side, which beam is constructed from a set of profiles. The set comprises a beam profile provided to serve as a beam of the terrace canopy. A beam-finishing profile, i.e. a front cover, is attached to the beam profile by means of a first connection means provided on the beam profile.

However, it has been found that the set disclosed in BE 2014/0015 still offers too little the possibility for an integration of the many different types of side wall infill that are common with terrace canopies.

DESCRIPTION OF THE INVENTION

It is an object of the present invention to provide a set of profiles for constructing a terrace canopy that can be used in more variations of the terrace canopy.

This object is achieved in that the set further comprises: a first spacer profile provided with a second connection means and a third connection means; a second spacer profile different from the first spacer profile and provided with said second connection means and fourth connection means, the first and second connection means configured together for attaching one of said spacer profiles to the beam profile; a first beam-finishing profile connected to the first spacer profile by the third connection means, the first beam-finishing profile having an outwardly facing surface located at a first distance from said upright wall; and a second beam-finishing profile connected to the second spacer profile by the fourth connection means, the second beam-finishing profile having an outwardly facing surface located at a second distance from said upright wall, wherein said beam is constructed of at least the beam profile, the first spacer profile and the first beam-finishing profile or of at least the beam profile, the second spacer profile and the second beam-finishing profile and wherein the first distance and the second distance are different.

Providing several, mutually different, spacer profiles allows to place the beam-finishing profile, namely the front cover, at different distances from the upright wall and the beam profile. In other words, the width of the beam can be varied, which benefits the variation in functionality. In particular, the width of the beam can be adjusted as a function of the wall infill. For example, if the wall infill comprises one or more (movable or stationary) panels, it is possible to design one or more beams thinner such that the beam together with the panels have the same width as another beam of the terrace canopy where none or another type of wall infill is present.

In an embodiment of the present invention the first connection means is connected to said upright wall by means of an opposite wall. The horizontal wall contributes to the distance between the upright wall and the beam-finishing profile.

In an embodiment of the present invention, the first beam-finishing profile comprises a fifth connection means, in particular a pin, configured to cooperate with said third connection means. Providing corresponding connection means on the first beam-finishing profile and the first spacer profile allows to connect them to each other in a simple manner.

In an advantageous embodiment of the present invention the beam comprises a sixth connection means, in particular a slot, and the first beam-finishing profile a seventh connection means, in particular formed by an end portion of the first beam-finishing profile, configured to cooperate with said sixth connection means. In this way, the first beam-finishing profile is attachable both to the beam profile and the first spacer profile, which yields a more robust connection between these three profiles. In addition, the use of two separate connections is advantageous for the strength and mutual positioning of the profiles. The fact is that, if only one connection is used for two profiles, there is more clearance in the mutual positioning, which may give rise to a divergent positioning, in particular due to wind loads and/or precipitation.

In an embodiment of the present invention, the second beam-finishing profile comprises an eighth connection means, in particular formed by an end portion of the second beam-finishing profile, configured to cooperate with said fourth connection means. Providing corresponding connection means on the second beam-finishing profile and the second spacer profile allows to connect them to each other in a simple manner.

In an embodiment of the present invention, said second spacer profile is formed by a drip profile. The second spacer profile therefore has a dual function, as a result of which such a profile can be used to protect the top side of a wall infill, such as a stationary wall, against precipitation dripping from the terrace canopy. A drip profile is a profile that is intended to divert moisture and droplets from a surface in a controlled manner and, in this case, to prevent such droplets from ending up on the top side of a wall infill. An example of a drip profile has been described in WO 2018/087632 A1.

In an alternative embodiment of the present invention, said second spacer profile is formed by a wall holder profile. In this way, the second spacer profile also has a dual function and a sliding wall can be integrated into the terrace canopy.

In an embodiment of the present invention, said first spacer profile is formed by a connection profile.

In an embodiment of the present invention, the first connection means comprises at least one hook and/or the second connection means comprises at least one hook and/or the third connection means comprises a female pin connection element and/or the fourth connection means comprises a slot. These different options offer flexibility when designing a terrace canopy.

In an embodiment of the present invention, the set further comprises: a support profile provided to serve as a support pillar of the terrace canopy; at least one first support-finishing profile attachable to a side of the support profile, the first support-finishing profile having an outward-facing surface which, when the first support-finishing profile is attached to the support profile, is located at a third distance from said side; and a second support-finishing profile attachable to said side of the support profile, the second support-finishing profile having an outwardly facing surface which, when the second support-finishing profile is attached to the support profile, is located at a fourth distance from said side, the third and fourth distance being different. In accordance with the beams of the terrace canopy, the width of the columns is also adjustable in this embodiment, for example according to the wall infill. In particular, this allows a wall infill to continue uninterruptedly along an outer corner of a column.

In an advantageous embodiment of the present invention, the outwardly facing surfaces of the first support-finishing profile and the first beam-finishing profile are located substantially in the same first plane and the outwardly facing surfaces of the second support-finishing profile and the second beam-finishing profile are located substantially in the same second plane, wherein these planes are typically different from each other. In this way, the outer side of the beams and the columns are aligned with each other such that a uniform appearance is obtained.

In an embodiment of the present invention, the first beam-finishing profile and the second beam-finishing profile are different. This allows to vary their embodiment in accordance with the connection to the beam profile.

BRIEF DESCRIPTION OF THE DRAWINGS

The invention will hereinafter further be explained in detail with reference to the following description and to the accompanying drawings.

EMBODIMENTS OF THE INVENTION

Figure 1:
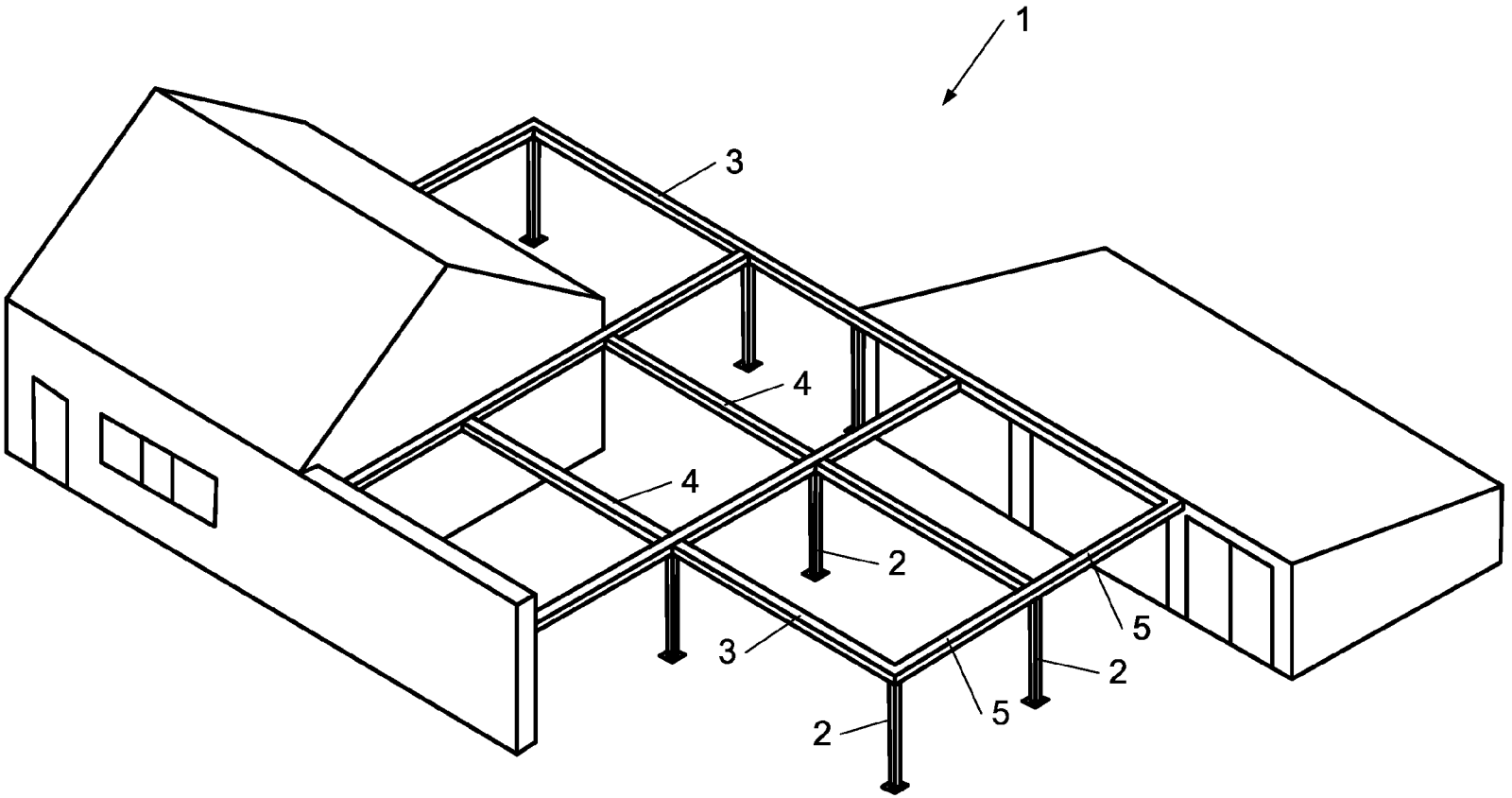
FIG. 1 shows a schematic view of a terrace canopy according to the invention.

The present invention will hereinafter be described using particular embodiments and with reference to certain drawings, but the invention is not limited thereto and is only defined by the claims. The drawings presented here are only schematic representations and are not limiting. In the drawings, the dimensions of certain components may be shown enlarged, which therefore means that the components in question are not shown to scale, and this for illustrative purposes only. The dimensions and relative dimensions do not necessarily correspond to the actual practical embodiments of the invention.

In addition, terms such as "first", "second", "third", and the like are used in the description and in the claims to distinguish between similar elements and not necessarily to indicate a sequential or chronological order. The terms in question are interchangeable under appropriate circumstances, and the embodiments of the invention may operate in other sequences than those described or illustrated herein.

The term "comprising" and derivative terms, as used in the claims, should not be construed as being limited to the means stated thereafter; the term does not exclude other elements or steps. The term should be interpreted as a specification of the mentioned properties, integers, steps, or components referenced, without excluding the presence or addition of one or more additional properties, integers, steps, or components, or groups thereof. The scope of an expression such as "a device comprising the means A and B" is therefore not limited only to devices consisting purely of components A and B. On the other hand, what is intended is that, for the purpose of the present invention, the only relevant components are A and B.

Figure 3A:
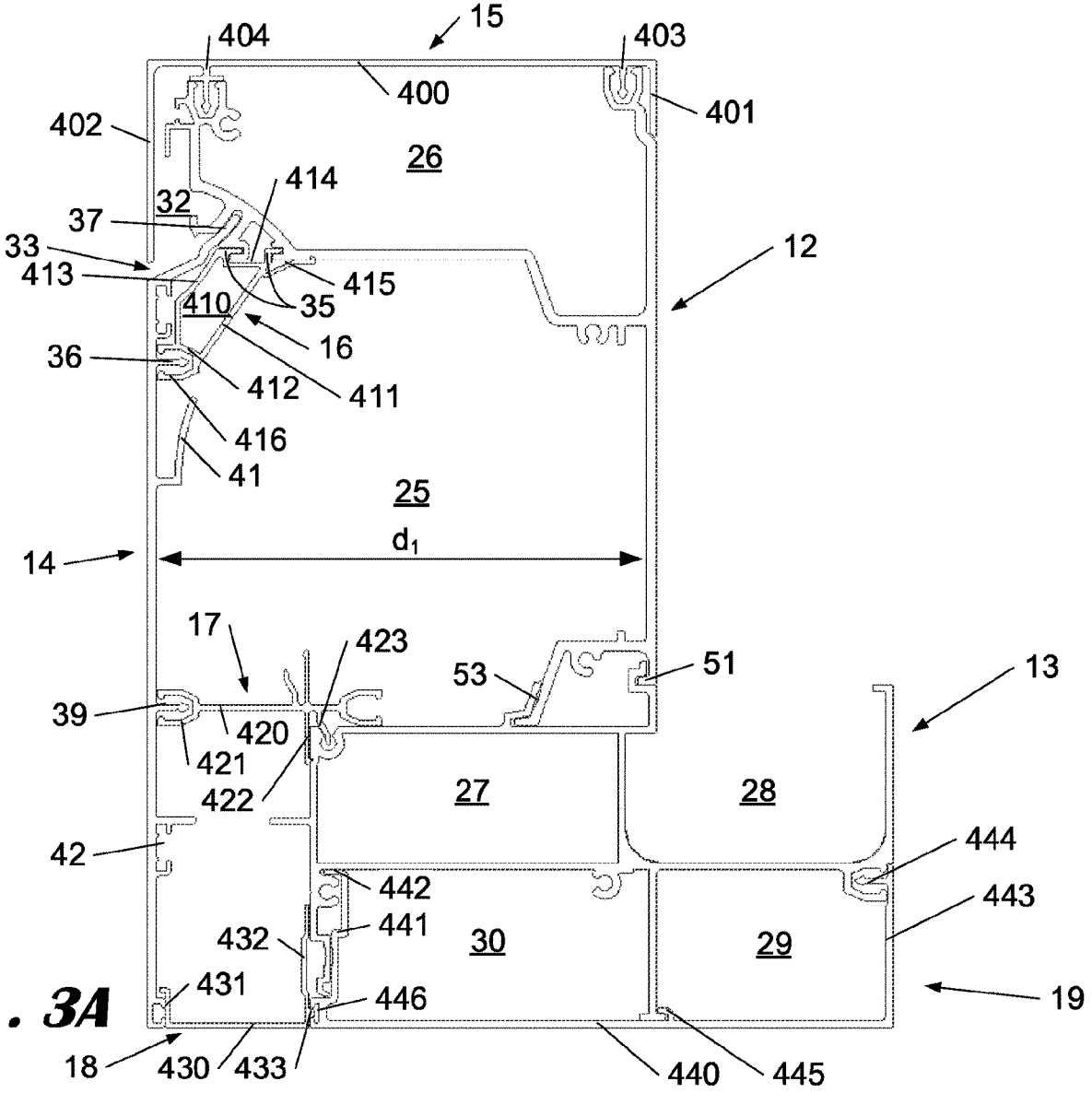
FIGS. 3A to 3D each show a cross-section through an alternative embodiment of an external pivot beam with different wall infill functionality.
Figure 3B:
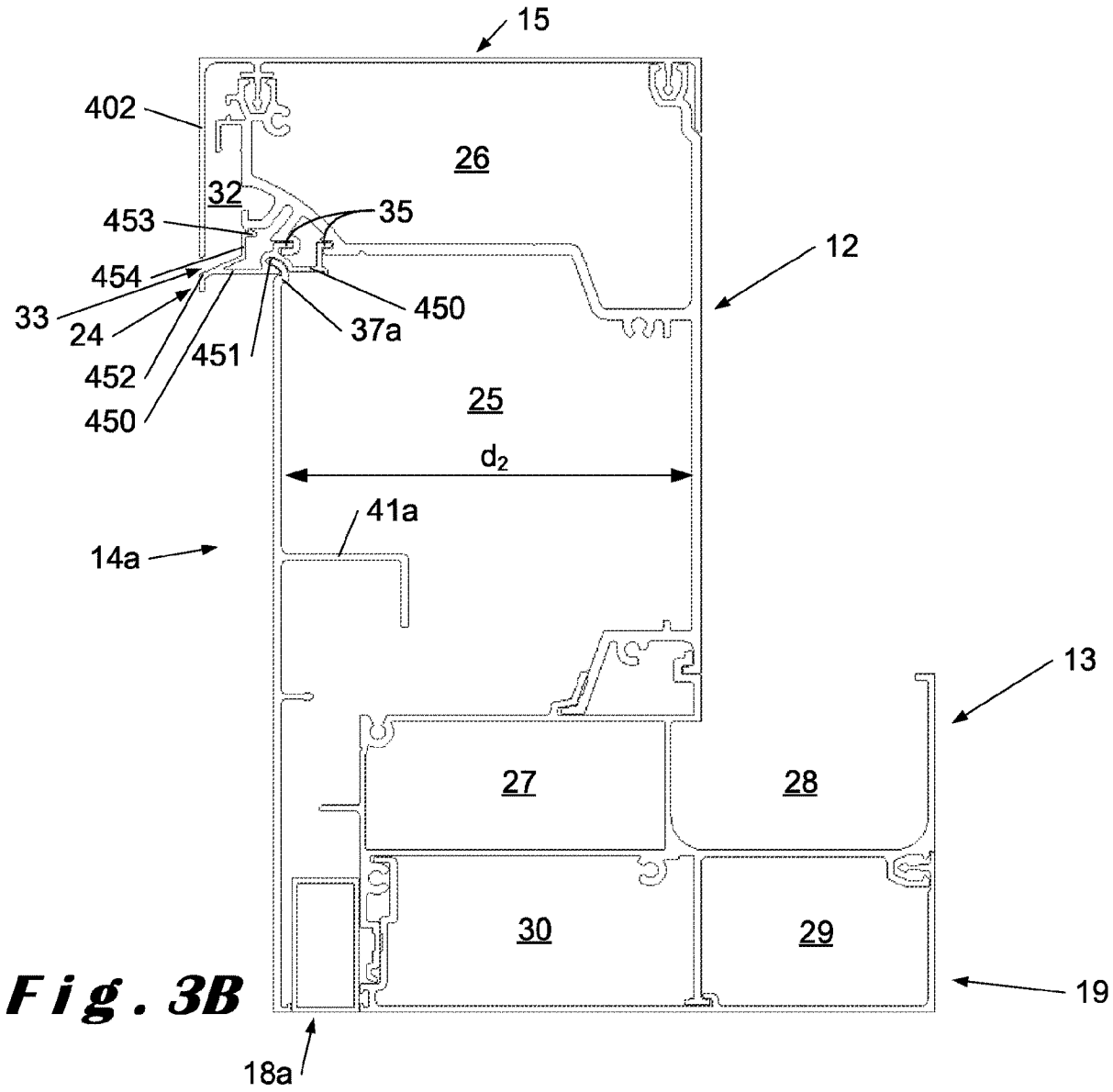
Figure 3C:
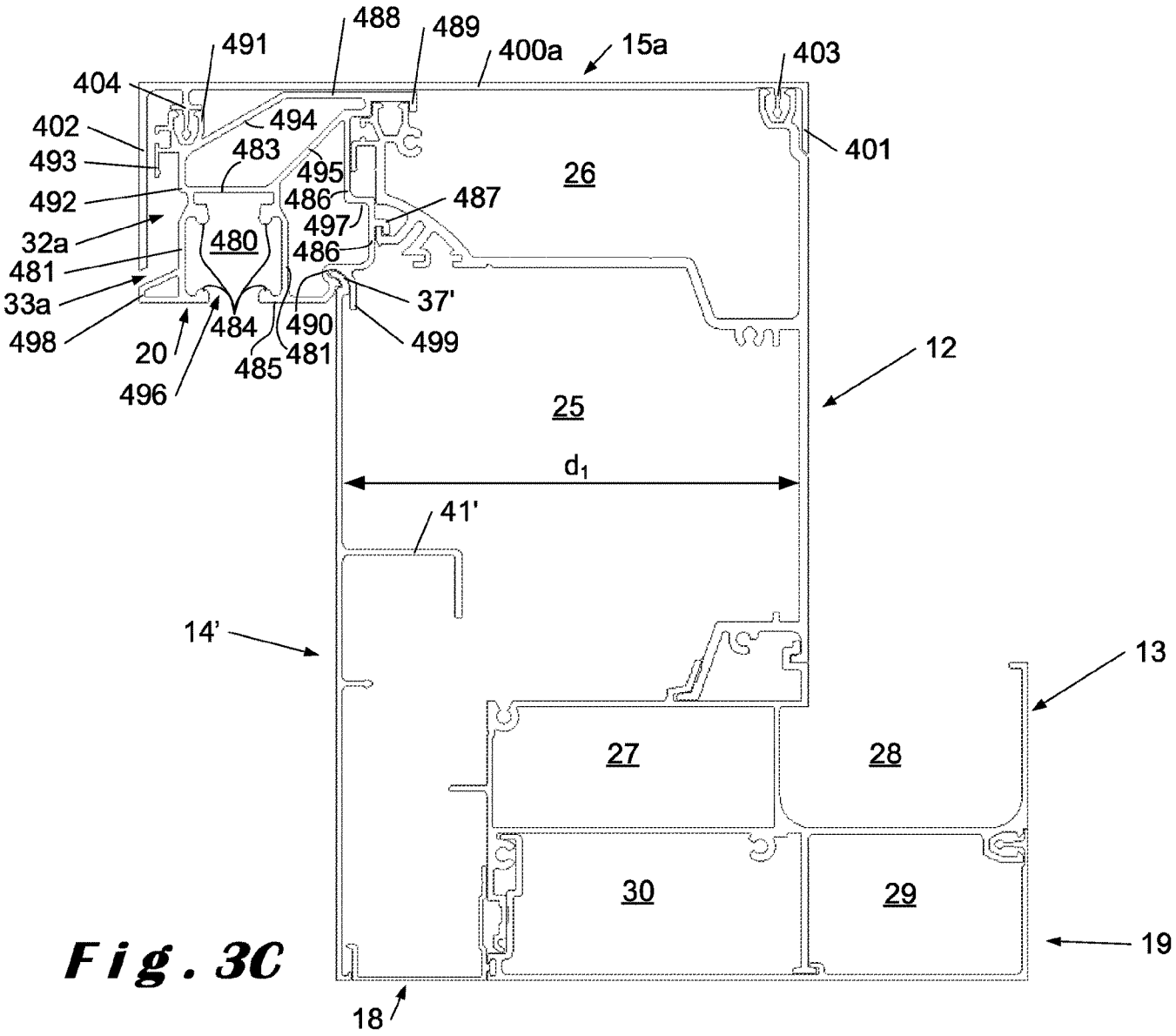
Figure 3D:
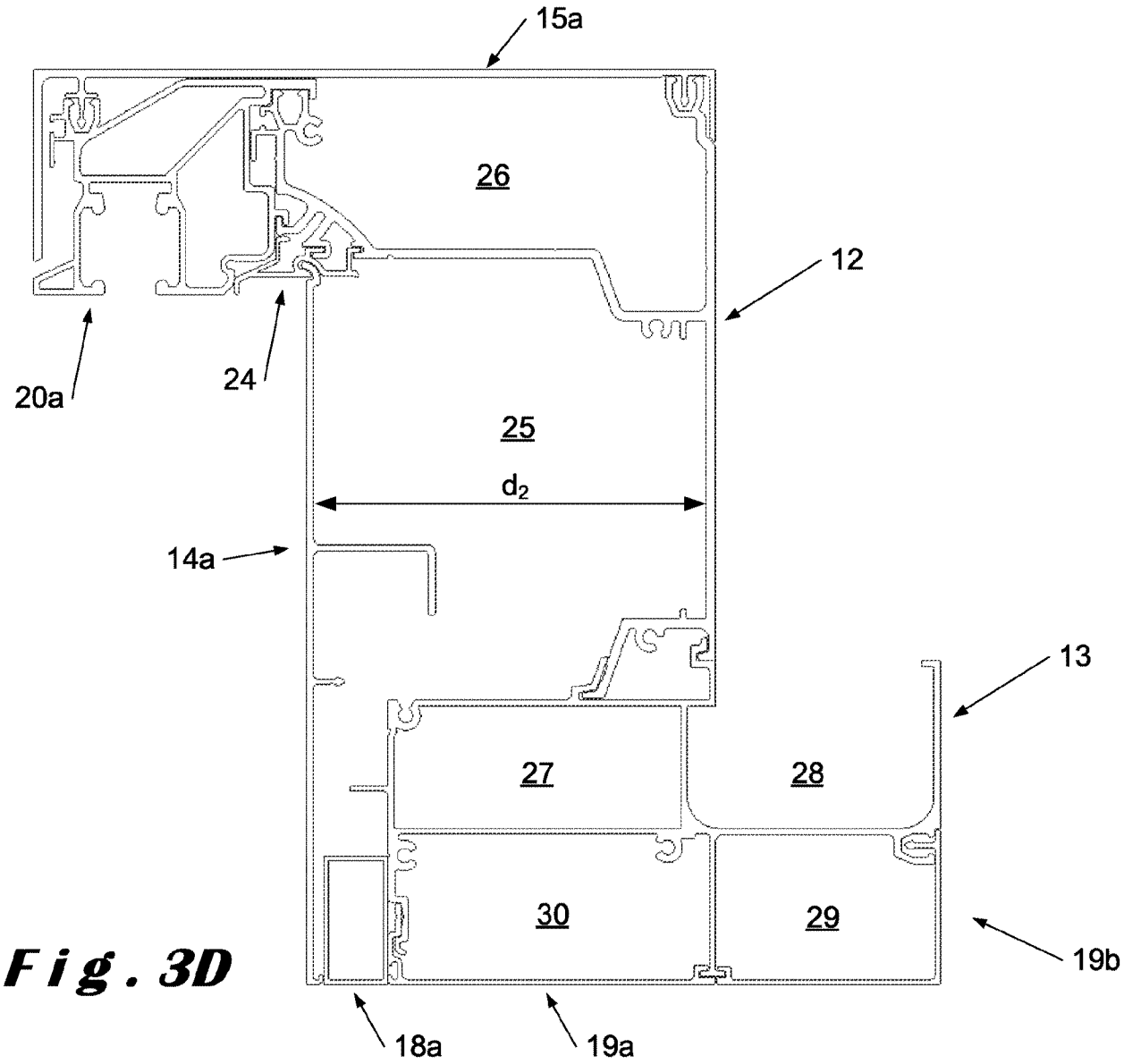
Figure 4:
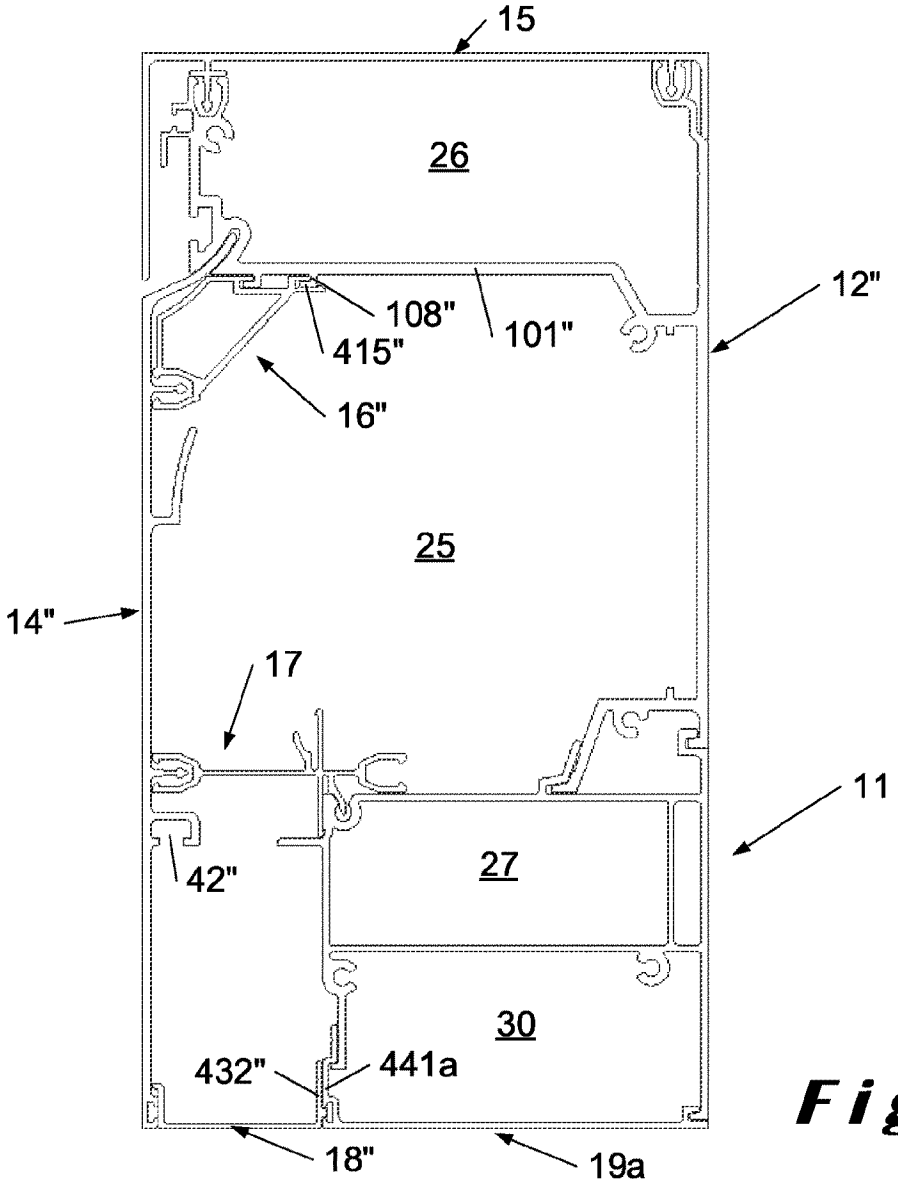
FIG. 4 shows a cross-section through a basic embodiment of a tension beam.

With reference to FIGS. 3 to 5, each reference to an orientation of the beams will be interpreted with reference to the position when mounted in the terrace canopy. In this way there are four orientations, namely above, below, outer side and inner side. Here, "above" refers to the part of the beam that is or will be oriented towards the top surface (the sky, e.g. the open sky), "below" refers to the part of the beam that is or will be oriented towards the ground plane (the soil, e.g. the terrace floor), "outer side" to the part of the beam that is or will be oriented away from the roof, i.e. away from the roof infill (i.e. the left side in FIGS. 3 to 5) and "inner side" to the part of the beam that is or will be oriented towards the inner side of the roof, i.e. towards the roof infill (i.e. the right side in FIGS. 3 to 5).

The term "substantially" includes variations of +/−10% or less, preferably +/−5% or less, more preferably +/−1% or less, and more preferably +/−0.1% or less, of the specified state, insofar as the variations are applicable to function in the disclosed invention. It is to be understood that the term "substantially A" is intended to also include "A".

FIG. 1 illustrates a terrace canopy 1 for a ground surface, for example a terrace or garden. The terrace canopy comprises a plurality of columns 2 that support different beams 3, 4, 5. The columns and beams together form frames to which wall infills 6 and/or roof coverings 7 can be attached, as described hereafter. The terrace canopy 1 comprises three types of beams 3, 4, 5, namely:

- a beam 3 which, on the outside of the terrace canopy, serves as external pivot beam 3;
- a beam 4 which, centrally in the terrace canopy 1, serves as the central pivot beam 4; and
- a beam 5 which serves as a tension beam 5.

It will also be appreciated that the beams 3, 4, 5 can be attached to other structures, for example a wall or facade, instead of relying solely on columns 2 as shown in FIG. 1. In such a way, the terrace canopy 1 can be used generally used to shield an outdoor space as well as an indoor space.

FIGS. 2A to 2J show terrace canopies 1 with alternative wall infills 6. The terrace canopies 1 shown have in common that four support columns 2 are provided which support a frame, also called a roof frame. The frame is formed from two external pivot beams 3 and two tension beams 5 in between a roof covering 7 is provided.

In the embodiments shown, the roof covering 7 is formed by slats which are rotatably attached at their front ends to pivot beams 3. The slats are rotatable between an open position and a closed position. In the open position, there is an intermediate space between the slats through which, for example, air can be introduced into the underlying space or can leave this underlying space. In the closed position, the slats form a closed roof with which the underlying space can be shielded from, for example, wind and/or precipitation, such as rain, hail or snow. For the drainage of precipitation, the slats are typically arranged sloping towards one of both pivot beams 3.

The slats are typically manufactured of a rigid material. This can be aluminium, for example. Aluminium has many advantages as a material, as it is at the same time robust and light-weighted, it can withstand bad weather conditions and requires little maintenance. However, other materials are also suitable and their advantages or disadvantages are assumed to be known by the skilled person. A slat can be produced using various techniques depending on the material, including extrusion, cutting, setting, casting, welding, etc. The appropriate production technique is assumed to be known by the skilled person. Preferably, the slats are manufactured by means of an extrusion process. Optionally, filling elements of, for example, polycarbonate, glass, wood, etc. can be used to fill the hollow slats at least partially, for instance to obtain a different appearance of the slat.

Additionally, in an embodiment, in their open position, the slats may optionally be provided slidable in the terrace canopy 1, in order to further increase the control options in terms of incidence of light, radiant heat and ventilation.

More generally, the roof covering 7 is stationary or movable. A movable roof covering comprises, for example, tiltable and/or slidable slats (such as described above) and/or roll-in/roll-out screens and/or slidable panels. The individual elements of the movable roof covering 7 in their closed position form a substantially watertight roof with which the underlying space can be screened off from, for instance, wind and/or precipitation, such as rain, hail or snow. This roof covering 7 is typically drained to the pivot beams 3, 4 and from there directly or via the tension beams 5 to the columns 2. By sliding and/or rotating the slats and/or the panels and/or by rolling in a screen, the roof covering 7 can be at least partially opened and/or closed in order to be able to determine the incidence of light, radiant heat, ventilation, precipitation, etc. to the space below the roof covering 7 as desired.

Wall infills 6 are typically intended to screen openings below the terrace canopy 1 between the columns 2. The wall infills 6 can be stationary or movable. Movable side walls comprise, for example, roll-in/roll-out screens and/or wall elements that are slidably arranged with respect to each other, etc. Stationary side walls can be manufactured of various materials, such as plastic, glass, metal, textile, wood, etc. Combinations of different wall infills 6 are also possible.

Figure 2A:
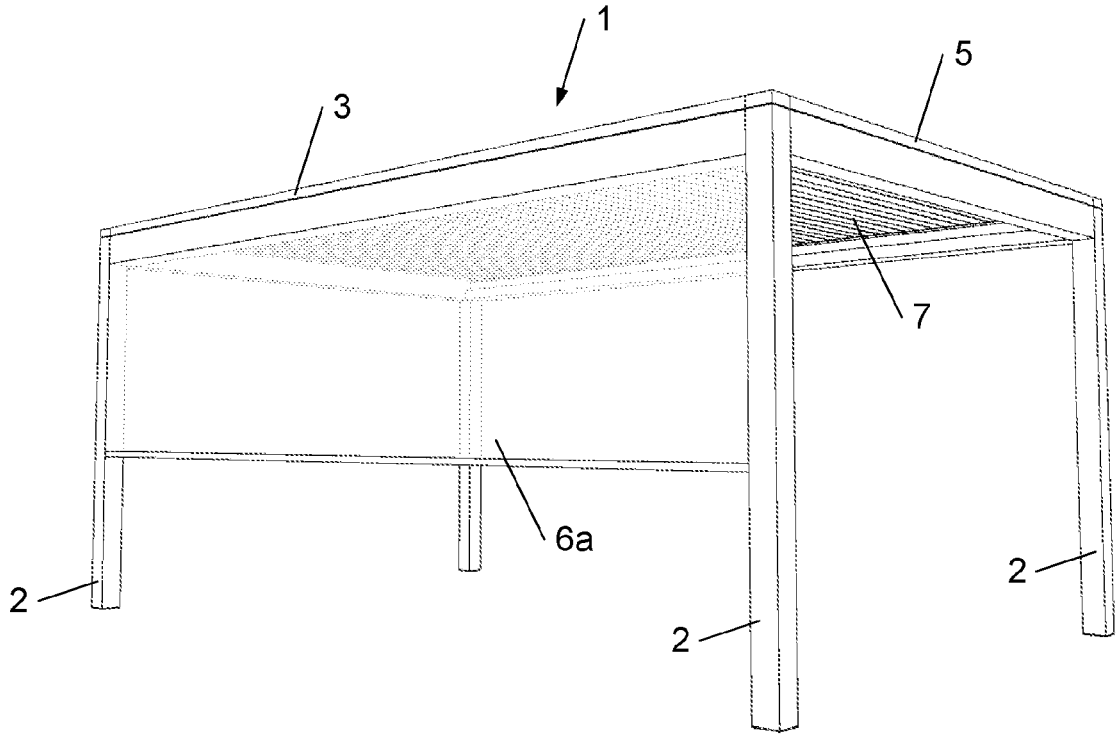
FIGS. 2A to 2J show alternative embodiments of the terrace canopy with different wall infills.

FIG. 2A illustrates a wall infill in the form of a roll-in/roll-out screen 5A. The screen 5A extends between two adjacent columns 2 and can be rolled out from the external pivot beam 3. The screen 5A mainly serves as a wind and/or sun screen.

Figure 2B:
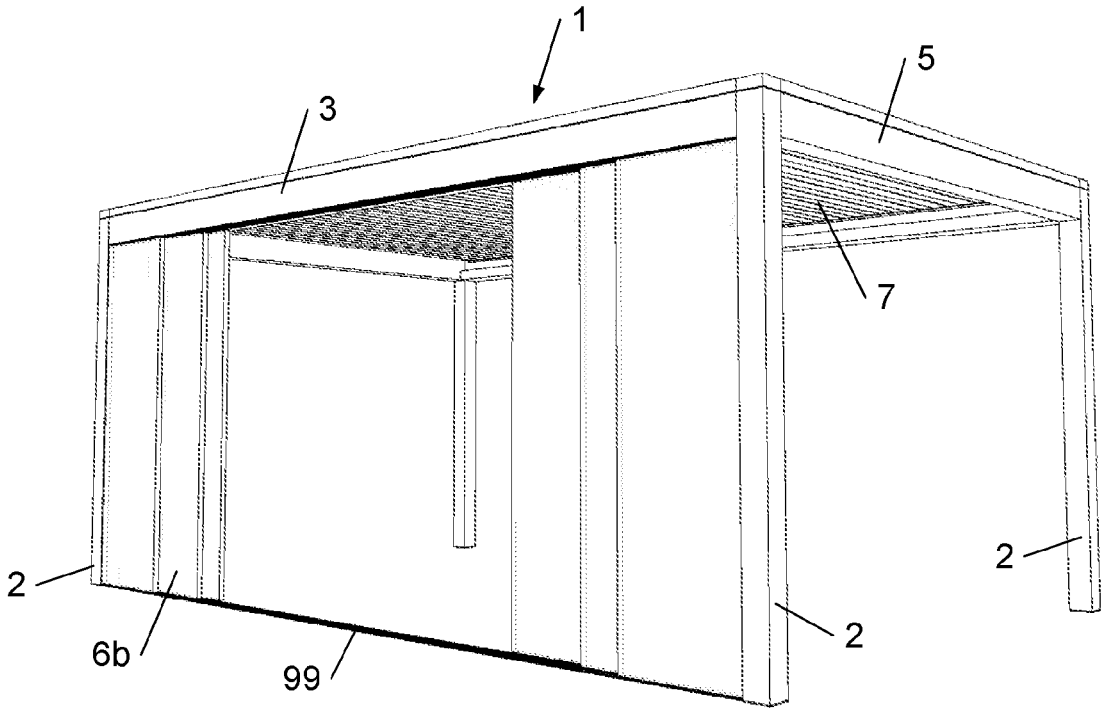
Figure 2C:
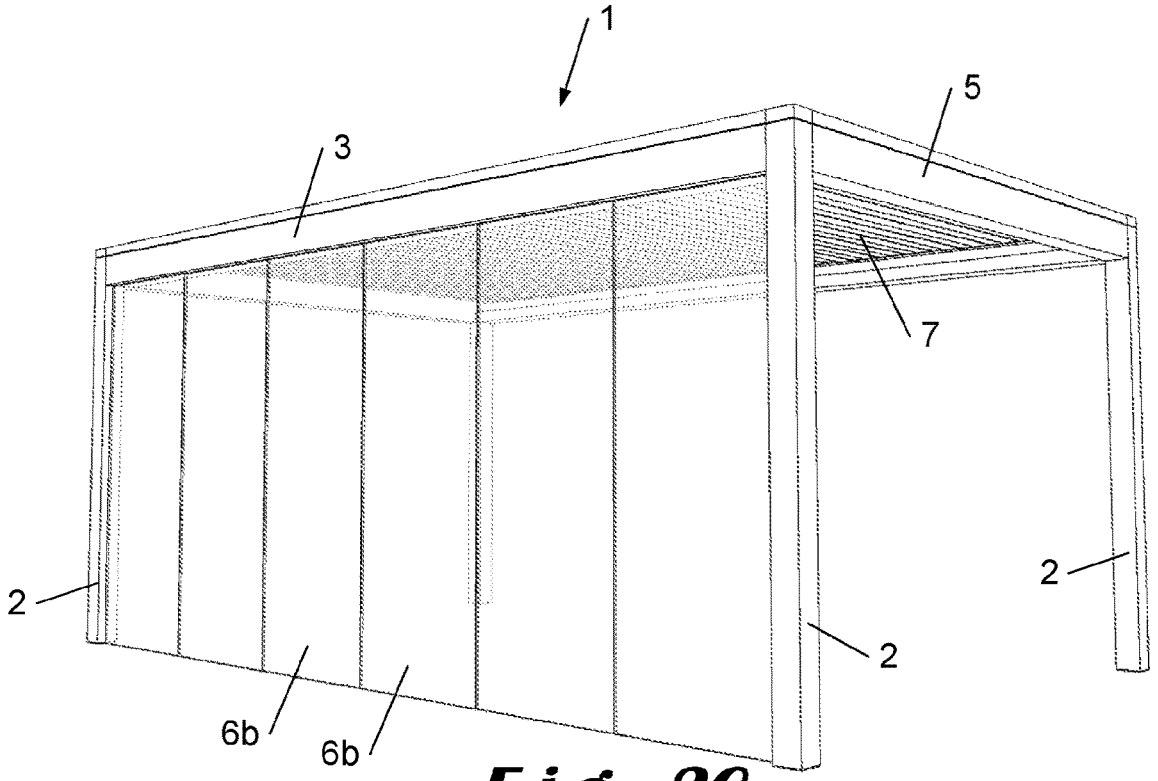
Figure 2D:
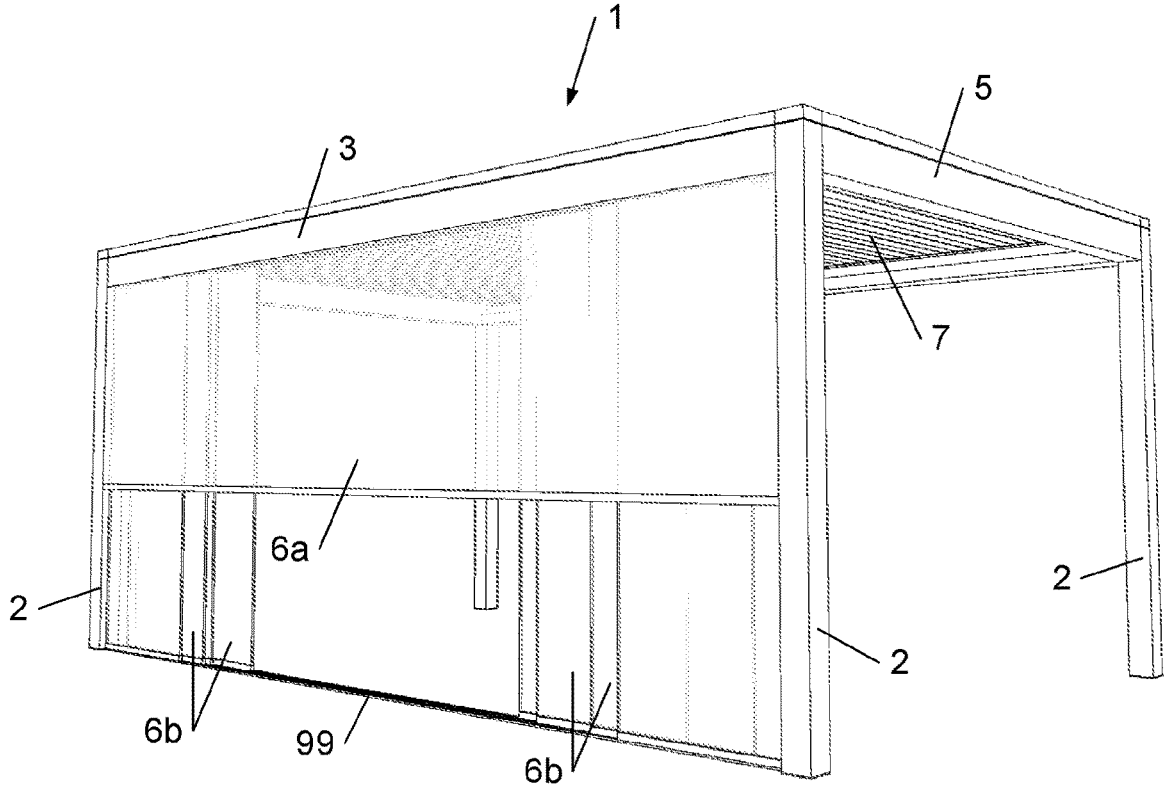

FIG. 2B illustrates a wall infill in the form of sliding wall panels 5B. In the embodiment shown, three panels 5B are provided on either side of the wall. The panels 5B are slidable in pairs (namely one on either side) in a rail provided for this purpose in the external pivot beam 3. On the ground, also a guide 99 is provided for the wall panels 5B, but this guide 99 is optional. FIG. 2C illustrates the terrace canopy 1 of FIG. 2B with the wall panels 5B in their closed position. The wall panels 5B are transparent and preferably made of glass. Naturally, non-transparent wall panels 5B are also possible. Their function is mainly wind and water protection, but depending on their material, sun protection is also possible. A combination of the wall infills of FIGS. 2A to 2C is shown in FIG. 2D. There, a double wall infill is provided, which, on the one hand, comprises a roll-in/roll-out screen 5A and, on the other hand, slidable wall panels 5B (in this case four panels 5B on either side).

Figure 2E:
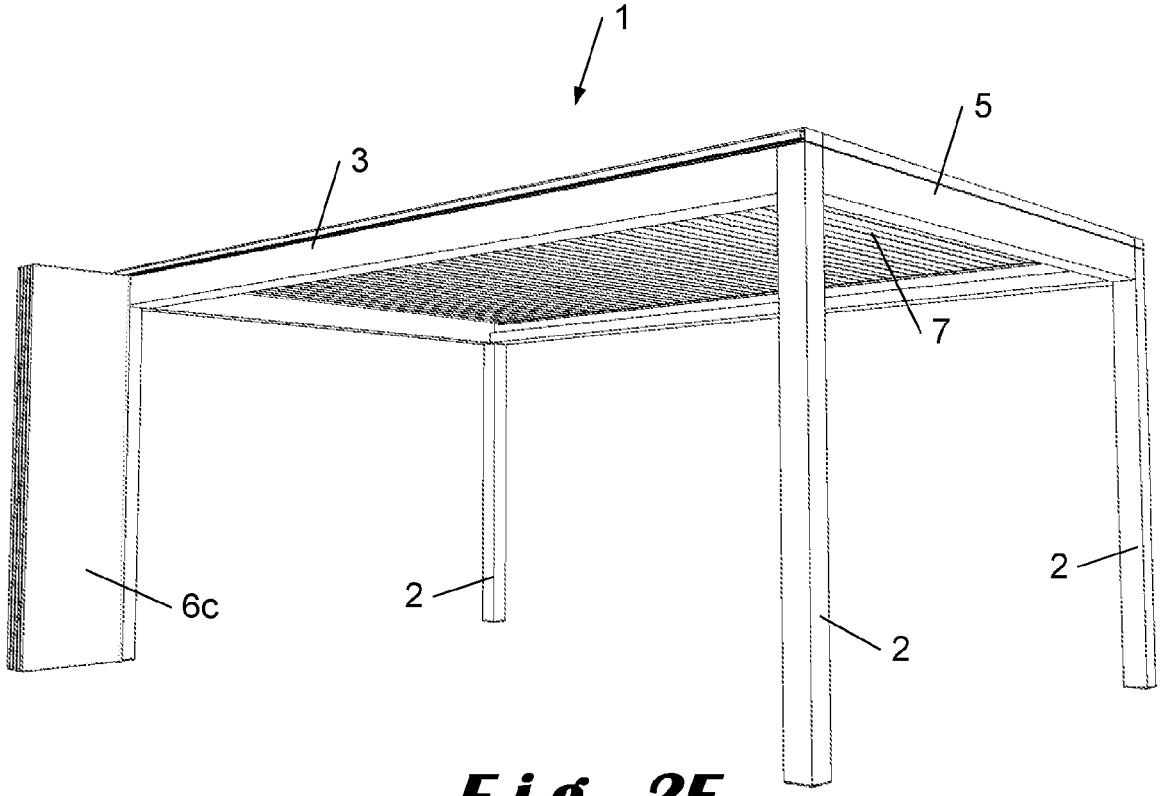
Figure 2F:
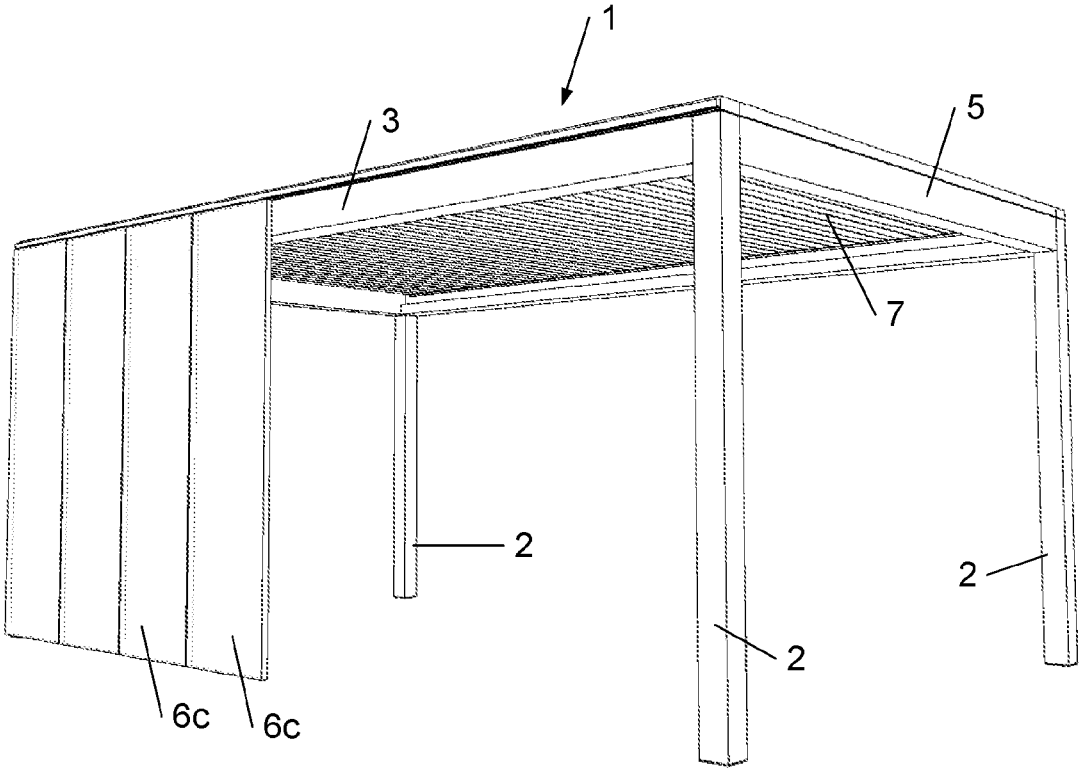
Figure 2G:
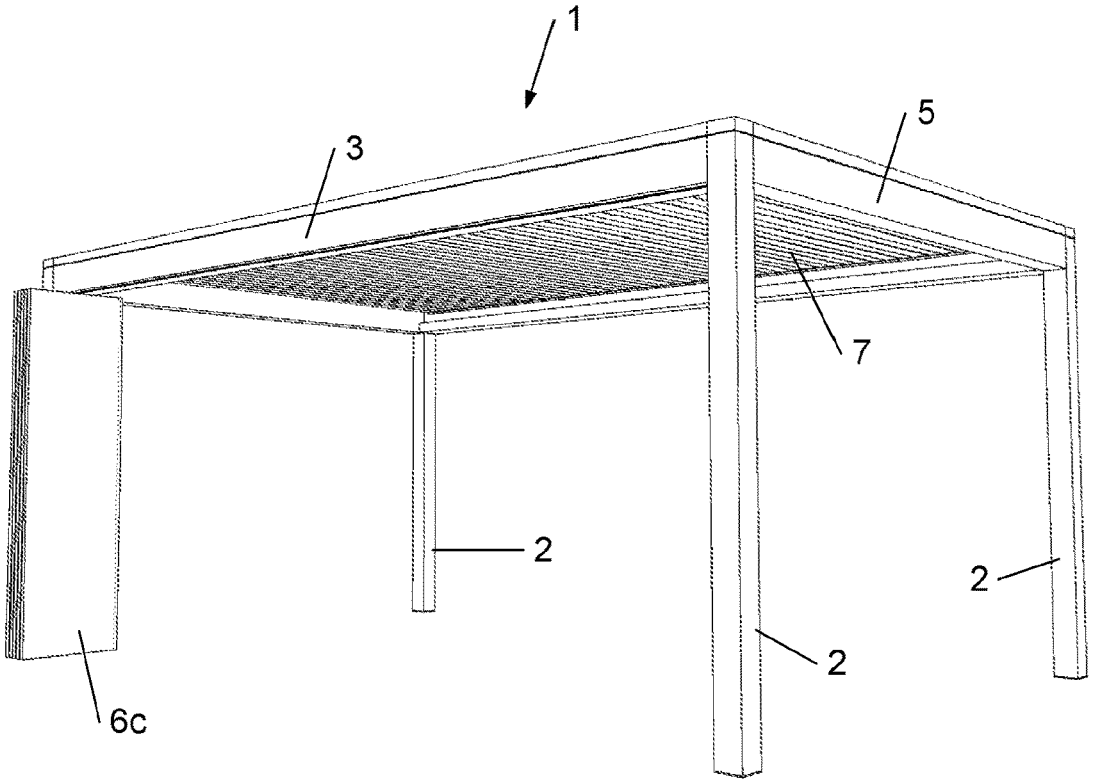

Another type of wall infill is shown in FIGS. 2E and 2F. The wall infill comprises foldable wall panels 5C. The wall panels 5C are foldable towards the column 2. FIG. 2F illustrates the terrace canopy 1 of FIG. 2E with the wall panels 5C in their closed position. Additional wall panels 5C are required to cover the entire wall between the columns 2. The wall panels 5C are transparent and preferably made of glass. Also, non-transparent wall panels 5C are also possible. Their function is mainly wind and water protection, but depending on their material, sun protection is also possible. The same type of wall infill, i.e. foldable wall panels 5C, is also shown in FIG. 2G. However, in this case, the panels 5C are located below the external pivot beam 3, while, in the embodiment of FIGS. 2E and 2F, the panels 5C, in their closed state, almost completely cover the external pivot beam 3.

Figure 2H:
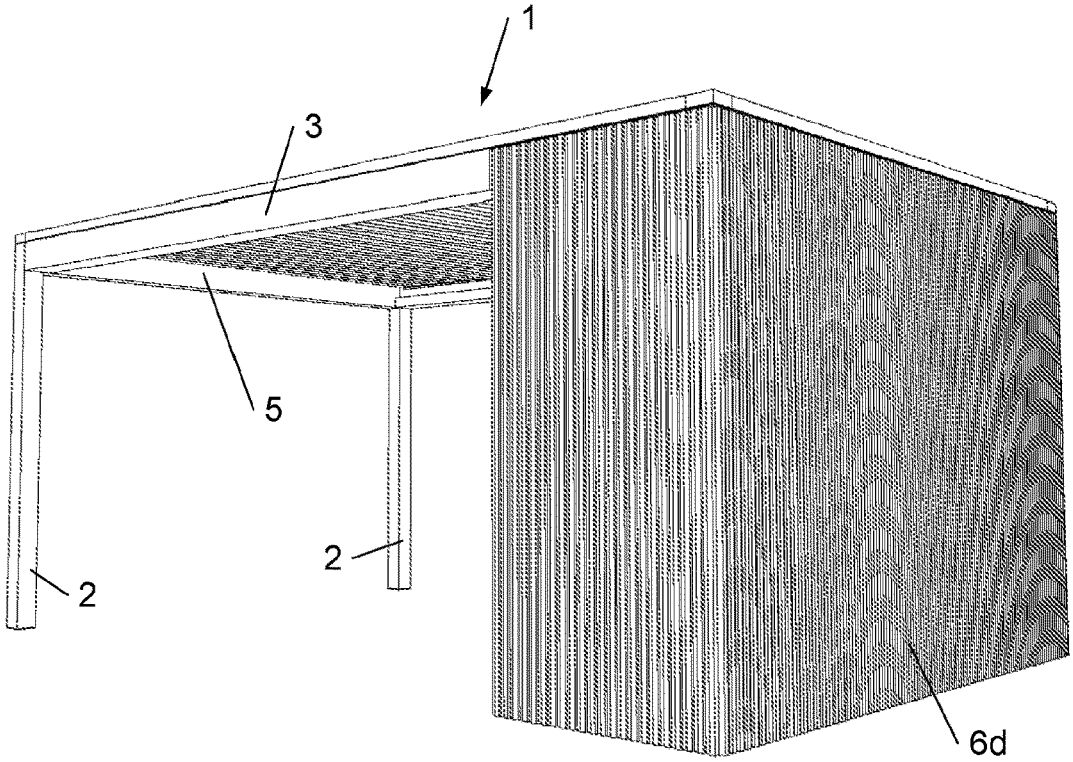
Figure 2I:
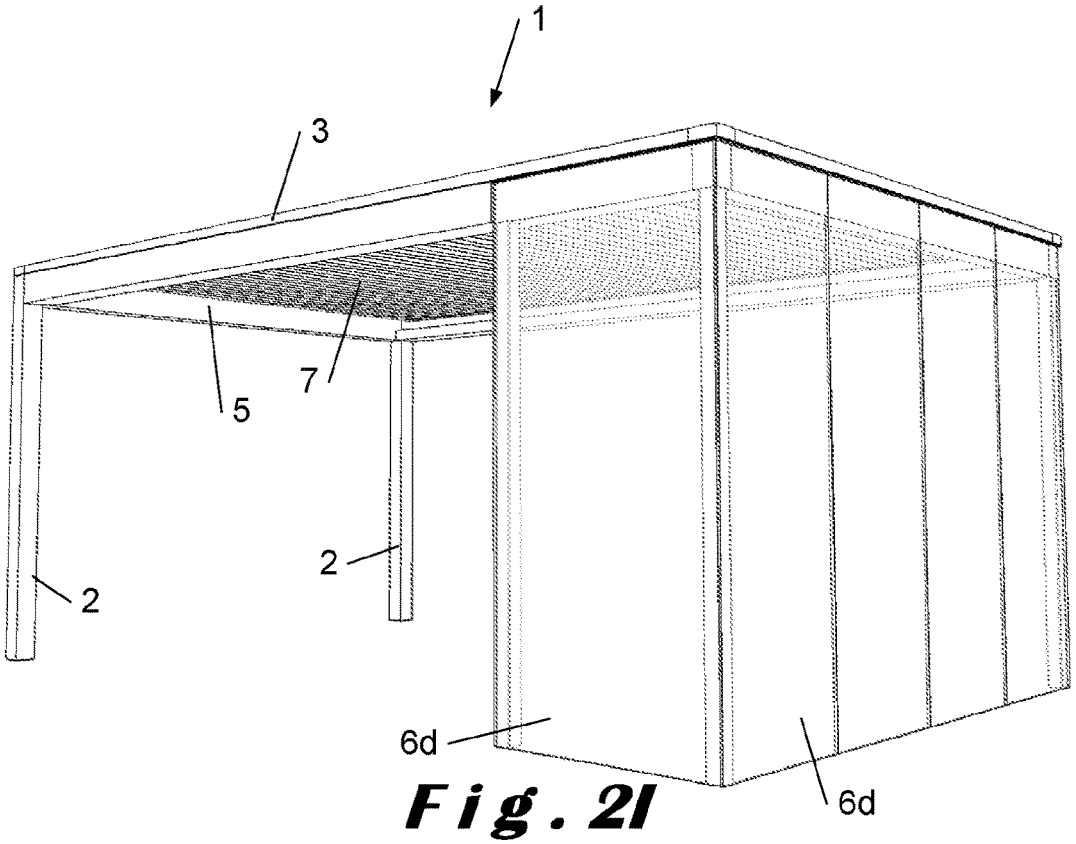
Figure 2J:
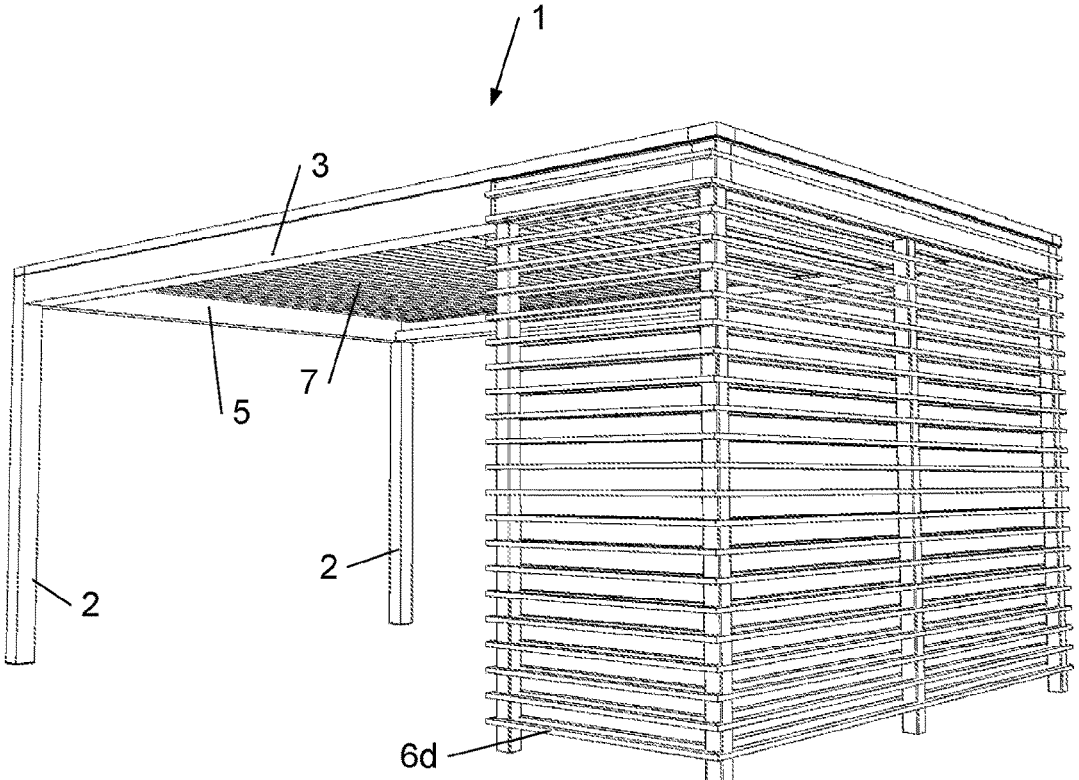

FIGS. 2H to 2J illustrate stationary wall infills 6*d*. The characteristic feature of the stationary wall infill 6*d* is that it is possible to have it continue uninterruptedly on the outside of a column 2. In other words, the column 2 may be hidden from view as in FIG. 2H. The stationary wall infill 6*d* can also be completely transparent as in FIG. 2I or partly transparent as in FIG. 2J. The function of a stationary wall infill depends on the type and generally includes wind, water and sun protection.

The different variations of beams 3, 5 will be described with reference to FIGS. 3 to 5. The beams 3, 5 are constructed from one or more profiles, as described hereafter. The profiles are typically manufactured of a rigid material. This can be aluminium, for example. Aluminium has many advantages as a profile material, as it is at the same time robust and light-weighted, it can withstand bad weather conditions and requires little maintenance. However, other materials are also suitable and their advantages or disadvantages are assumed to be known by the skilled person. A profile can be produced using various techniques depending on the material, including extrusion, cutting, setting, casting, welding, etc., with extrusion being the preferred technique. The appropriate production technique is assumed to be known by the skilled person.

The beams 3, 5 of the terrace canopy 1 are hollow as is apparent from FIGS. 3 to 5. The beams 3, 5 are composed of a plurality of profiles 10, 11, . . . , 24. In what follows, the different profiles of the beams and their interconnection are briefly discussed. It goes without saying that several variants are conceivable for both the composition of the beams and the interconnection of the profiles, as well as that the specific design of the profiles may differ. In addition, it is also possible that the functionality of different profiles is combined into the same integrally manufactured profile, for instance it is possible to form the base profile 12 together with the intern or external gutter profile 11, 13 as an integrally formed core profile.

It is generally intended to indicate profiles with the same placement and functionality, but with a divergent design with the same reference numeral by using one or more accent marks, e.g. base profile 12 and 12" in FIGS. 3A and 4. It is generally intended to indicate profiles with the same placement but with a modified form as a result of a modification in functionality of the beam by the same reference numeral by the use of letters, for example finishing profile 14, 14*a* in FIGS. 3A and 3B.

To form the beams 3, 5, the profiles 10, 11, . . . , 24 are connected to each other in a specific way. Generally, use is made of pin connections and/or hook connections. In a pin connection typically an elastic element (not shown) is present in a female element, for example a slot element, into which a male element, for example a pin, engages. Hence, a pin connection generally includes an elastically interlocking male and female element; an additional elastic element may be provided for this purpose, but this is not necessarily the case. The elasticity may also arise from the design of the male and female elements. Hook connections typically involve two elements with such a design that they hook into each other. There is no elastic element and the connection is separated by moving the elements away from each other in the correct direction.

In addition, generally, for each interconnection of two profiles, use is made of two separate connections. This improves the strength of the connection, but mainly contributes to the correct mutual positioning of the profiles. The fact is that if only one connection is used for two profiles, there is more clearance in the mutual positioning, which can give rise to a divergent positioning, in particular due to wind loads and/or precipitation loads.

A first design of an external pivot beam 3 is shown in FIG. 3A. The pivot beam 3 is intended not to be provided with a wall infill 6. The pivot beam 3 comprises a base profile 12 and a double gutter profile 13 connected to each other. The base profile 12 and the double gutter profile 13 are also shown per se in FIGS. 5A and 5B.

The base profile 12 (see FIG. 5A) comprises an upright wall 100 of which a horizontal wall 101 extends to the outer side of the base profile. The upright wall 100 is provided at the bottom with a first lower connection means 103, in particular a hooking means. The upright wall 100 also has a bottom branch 104 which ends in a second lower connection means 105. The lower connection means 103, 105 serve to attach the base profile 12 with the double gutter profile 13.

The double gutter profile 13 (see FIG. 5B) has a central cavity 27 which is formed at the top side by an top horizontal wall 200. The wall 200 ends on its inner side in an upright branch 202 which ends in a first top connection means 203, in particular a hooking means. The horizontal wall 200 is provided on its top side with an top branch 201 which serves as the second top connection means 205. The base profile 12 and the double gutter profile 13 are connected to each other by, on the one hand, hooking the hooking means 103, 203 into each other (i.e. hook connection 51) and, on the other hand, to connect the walls 105, 205 directly to each other, for example by riveting them (connection 53). Alternatively, these profiles may be manufactured integrally as one single core profile. The drawback here is that such a profile, in view of the considerable height, is not easy to manufacture by means of an extrusion process.

Figure 5A:
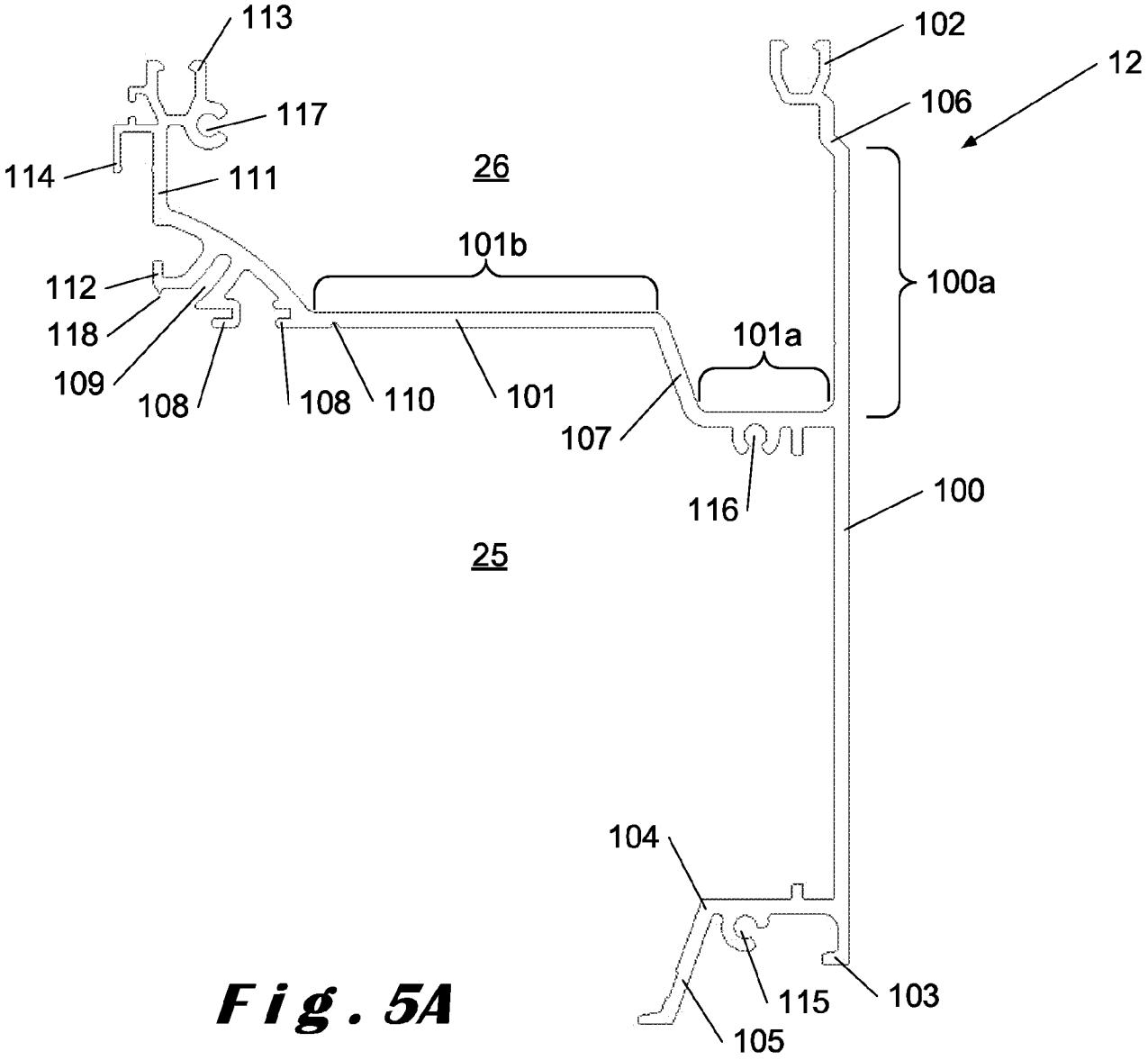
FIGS. 5A to 5C show individual profiles used in the construction of the external pivot bar and/or the tension bar.

FIG. 5A further illustrates that the upright wall 100 of the base profile 12 is provided on its top side with a bend 106, through which a first top connection means 102, in particular a female pin connection means, is provided further to the outer side of the base profile 12. As shown in FIG. 3A, the first top connection means 102 is used to connect the cover profile 15. The cover profile 15 comprises a horizontal wall 400 which merges at its ends into two upright walls 401, 402 and is therefore substantially U-shaped. The underside of the horizontal wall 400 is provided with two connection means 403, 404, in particular pins. The pin 403 is used together with the first top connection means 102 for connecting the cover profile 15 to the base profile 12. Due to the bend 106, the upright wall 100 of the base profile 12 and the upright wall 401 of the cover profile 15 are in the same plane.

The cover profile 15 serves to close off a technical space 26 in the external pivot beam 3. This technical space 26 may serve to house drive means for tilting the slats of the roof covering 7 and/or cabling for, for example, lighting, etc. In other words, the slats of a roof covering 7 are attached to a wall part 100*a* (see FIG. 5A) which forms part of the upright wall 100 and extends between the horizontal wall 101 and the bend 106. In particular, the slats are partially positioned through these and fixedly attached to an attachment mechanism (not shown) inner side the technical space 26. The presence of this attachment mechanism is also part of the reason why the horizontal wall 101 comprises two wall parts 101*a*, 101*b* which are at different heights and are connected by a bend 107. The lower placement of wall part 101*a* leaves sufficient space for the attachment mechanism, while the higher placement of wall part 101*b* allows the necessary space for arranging a roll-in/roll-out screen in a screen cavity 25.

The horizontal wall is provided near its end with a plurality of connection means, the functionality of which is described hereafter. The connection means comprise a first connection means 108, in particular a hooking means formed by two hooks, and a second connection means 109, in particular a slot. These connection means serve for the attachment of a front cover 14 for shielding the screen cavity 25. This front cover 14 typically forms the outer side of the external pivot beam 3. The distance between the front cover 14 and the upright wall 100 of the base part is indicated as d1 in FIG. 3A.

The front cover 14 is attached to the base profile by means of a connection profile 16. The connection profile 16 comprises a hollow chamber formed between four walls 411, 412, 413, 414. The wall 414 forms the top side of the connection profile 16 and is provided with a first connection means 35, in particular a hooking means formed by two hooks, corresponding to the first connection means 108. From the top wall 414, a branch 415, in particular elastically deformable, extends towards the inner side of the external pivot beam 3. The end of branch 415 engages in a notch 110 in the base profile 12. On the bottom wall 412, the connection profile 16 is provided with a second connection means 416, in particular a female pin connection means. The second connection means 416 serves for receiving a corresponding second connection means 36, in particular a pin. This second connection means 36 is provided on the inner side of the front cover 14. A further attachment of the front cover 14 to the base profile 12 is formed, in particular by a pivotal movement, by placing the end part 37 of the front cover 14 in a slot 109 in the base profile 12 intended for this purpose.

In itself, the above-described attachment of the front cover 14 to the base profile 12 is sufficient. However, in view of the relatively long distance over which the front cover 14 downwardly extends, it is preferable to use an additional support profile 17 and/or a filler profile 18. The support profile 17 comprises a horizontal wall 420 terminating in a first connection means 421, in particular a female pin connection means. A corresponding connection means 39, in particular a pin, is provided on the inner side of the front cover 14. At the other end of the horizontal wall 420, an upright wall 422 and a branch 423, in particular elastically deformable, are provided. The upright wall 422 serves as a abutment against the internal cavity 27 of the double gutter profile 13, i.e. against the outer upright wall 206. The end of the upright wall 422 engages in a notch 207 in the double gutter profile 13, in particular a notch 207 in the outer wall 206 of the cavity 27. Similarly, the end of the branch 423 engages in an opening 208 near the corner of the internal cavity 27.

The filler profile 18 is generally U-shaped with a flat underside 430 and upright side walls 431, 432. The upright side wall 432, in particular the end thereof, is intended to be rigidly connected to wall part 209*a* of an outer upright branch 209 of the double gutter profile 13. In an example, rivets are used for this connection. The remaining upright side wall 431 is free and serves as an abutment for the underside of the front cover 14. If desired, the upright side wall 431 can also be fixedly attached to the front cover 14. Finally, it should be noted that the upright side wall 432 is provided with a connection means 433, in particular a pin, the function of which will be described later.

In the embodiments shown, the front cover 14 is further provided with a reinforcing rib 41 and a slot 42. The reinforcing rib 41 contributes to the rigidity of the front cover 14 and is useful for obtaining the required resistance at higher loads, especially when bridging relatively long lengths.

Naturally, the front cover 14 is detachable by disconnecting several of the connections. Thereby, the screen cavity 25 is accessible such that modifications, adjustments and/or repairs may be made, if necessary. In a similar manner, the cover profile 15 is removable for modifications, adjustments and/or repairs of elements in the technical space 26, such as the drive of the slats that may form the roof infill 7.

FIG. 5A further illustrates that the horizontal wall 101 merges into an outer upright wall 111 which is provided on its underside with a lower connection means 112, in particular a hooking means, and on its top side is provided with a second top connection means 113, especially a female pin connection means. As shown in FIG. 3A, the second top connection means 113 is used to connect the cover profile 15 via pin 404. Also, the outer side of the upright wall 111 is provided with a branch 114 that serves as connection means and/or container. An opening 33 is provided between the front cover 14 and the cover profile 15, in particular the outer wall 402 thereof.

Figure 5B:
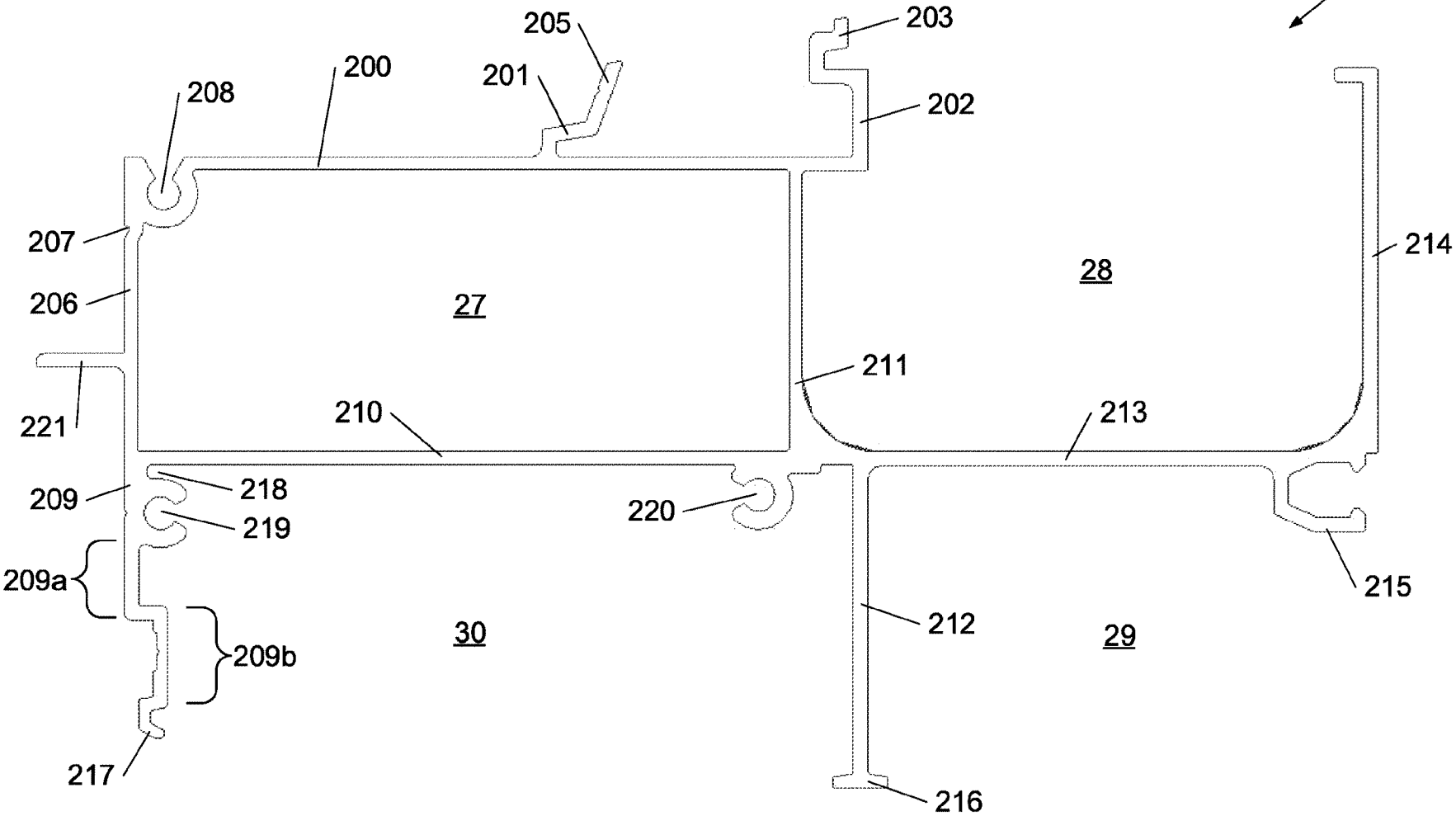

FIG. 5B shows more details about the double gutter profile 13 of the external pivot beam 3 shown in FIG. 3A. The double gutter profile 13 comprises an top horizontal wall 200, an outer upright wall 206, a bottom horizontal wall 210 and an upright intermediate wall 211 which together enclose the cavity 27. Further walls of the double gutter profile 13 are a bottom outer branch 209 which is substantially the extension of the outer wall 206, a horizontal branch 213 which is substantially an extension of the bottom horizontal wall 210, a lower inner branch 212 which is substantially the extension of the intermediate wall 211, and an upright inner side wall 214 extending upwardly from the end of the branch 212 and defining a space 28 together with the branch 212 and the intermediate 211. The walls 209, 212, 213 of the double gutter profile 13 also form a number of spaces. For example, there is a space 29 located below the external gutter 28 and next to the branch 212. Furthermore, there is also a space 30 located between the branches 209, 212. In the external pivot beam 3 of FIG. 3A, these spaces have no function, such that they can be hidden from view by providing an end profile 19.

The external pivot beam 3 is intended to be placed on the outer side of the terrace canopy 1 and should provide for water drainage of precipitation incident on the terrace canopy. In particular, this precipitation may, for example, be collected by a slatted roof 7 which drains precipitation to this pivot beam 3. The roof infill 7 drains the precipitation to the pivot beam 3 where it is collected in the external gutter 28. Between the external gutter 28 and the cavity 27 the intermediate wall 29 is present which is provided with one or more openings, for example a series of perforations, such that the precipitation from the external gutter 28 is diverted to the cavity 27. That is why the bottom of the external gutter 28 also preferably slopes towards the cavity 27. The cavity 27 serves as an internal gutter for the passage of precipitation from one or more adjoining pivot beams 3 to a column 2 along which this precipitation may leave the terrace canopy 1.

Furthermore, the double gutter profile 13 is further provided with an inner connection means 215, in particular a female pin connection means, of a lower inner connection means 216, in particular a hooking means, which forms the end of the branch 212 of a bottom outermost connection means 217, in particular a hooking means, which forms the end of the branch 209, and a connection means 218, in particular a hooking means, just below the inner gutter 27. The function of the lower outer connection means 217 is not further described, while the function of the connection means 215, 216 and 218 is described hereafter.

The end profile 19 is substantially U-shaped with a bottom wall 440 and two upright walls 441, 443. The bottom wall 440 is provided on its top side with a connection means 445, in particular a hooking means, provided to cooperate with the lower inner connection means 216 for the attachment of the end profile 19 to the double gutter profile 13. The upright inner side wall 443 is provided on its top side with a connection means 444, in particular a pin, provided to cooperate with the inner connection means 215 for attaching the end profile 19 to the double gutter profile 13. Furthermore, the upright outer wall 441 is provided on its top side with a connection means 442, in particular a hooking means, provided to cooperate with the connection means 218 for attaching the end profile 19 to the double gutter profile 13. The bottom outer connection means 446 is in turn provided to cooperate with the connection means 433 on the filler profile 18 for their interconnection.

Furthermore, the external pivot beam 3 is further provided with screw channels 115, 116, 117, 208, 219, 220 for screwing a headboard to an end of this beam 3 with the aid of screws or bolts for the purpose of connecting the beam with a column of the terrace canopy 1. Screw channel 115 is provided on the underside of the branch 104; screw channel 116 is provided on the underside of wall part 101*a*; screw channel 117 is provided adjacent to the second top connection means 113 in the technical space 26; the screw channel 208 is provided on the top outer corner of the internal gutter 27; and the screw channels 219, 220 are provided below the internal gutter 27 on either side thereof. Of course, more or less screw channels are also possible and/or the placement thereof may differ.

It should be understood that other ways are possible with fewer or more connection means to connect together the different profiles forming the external pivot beam 3. Additional connections, for example by means of glue, bolts, rivets, etc., may also be provided between certain profiles in order to connect these substantially permanently to each other. Rivets can be used, for example, to join walls 105, 205 or walls 209*b*, 441 or walls 209*a*, 432.

As already described above, the external pivot beam 3 (FIG. 3A) is intended to not use a wall infill, unlike the external pivot beams of FIG. 3B and onwards. This also immediately means that this external pivot beam 3 is almost completely visible in the terrace canopy 1. It is therefore advantageous that the visible surfaces have a sleek finish. Examples include: the co-planarity of the front cover 14 and the cover wall 402; the co-planarity of the upright wall 100 of the base profile 12 and the cover wall 401; the co-planarity of the filler profile 18 and the end profile 19; the only sporadic presence of an opening between visible profile surfaces; etc.

FIG. 3B illustrates a second type of external pivot bar, wherein the pivot bar is intended to form a side wall 6. Identical elements will be indicated by the same numeral and are not described.

The pivot beam of FIG. 3B is designed to cooperate with a stationary wall (see FIGS. 2H to 2J). The main differences with the pivot bar of FIG. 3A are the design of the front cover 14*a* and the filling element 18*a* and the presence of a drip profile 24 as an alternative to the connection profile 16.

The drip profile 24 has a substantially horizontal wall 450 which is provided on its top side with first connection means 35, in particular a hooking means formed by two hooks, corresponding to the first connection means 108 in the base profile 12. The drip profile 24 also has a second connection means 453, in particular a hook as the end of an elastically upright wall 454. This second connection means 453 engages a corresponding connection means 118 (see FIG. 5A), in particular a hook on the underside of the lower connection means 112, on the base profile 12. The connection means 35, 108, 118, 453 together ensure the attachment of the drip profile 24 to the base profile 12.

On its outwardly facing side, the drip profile 24 is finished with an upright wall 452 extending downwardly from the horizontal wall 450. In particular, this upright wall 452 is located in the same plane as the cover wall 402. A slot 451 is provided at the bottom side of the horizontal wall 450 which has the same function as slot 109 in the base profile 12, namely an attachment for the front cover 14*a*, in particular the end 37*a* thereof. There is also the opening 33 present between the outer wall 402 of the cover profile 15 and the upright wall 452 of the drip profile 24.

The front cover 14*a* has again a substantially flat outer side, which, in this embodiment, does not lie in the same plane as the cover wall 402, but is located more towards the inner side of the external pivot beam 3. In particular, the distance between the outer side of the front cover 14*a* and the upright wall 100 of the base profile 12 indicated as d2 in FIG. 3B is smaller than the distance d1 indicated in FIG. 3A. This allows to place the stationary wall 6*d* such that it lies substantially in the same plane as the cover wall 402. In particular, the stationary wall 6*d* is located between the outer side of the front cover 14*a* and the upright wall 452 of the drip profile 24 with its top side substantially against the underside of the horizontal wall 450. This also immediately explains the additional function of the drip profile 24, in particular the wall 452, namely, to prevent the incidence of precipitation on the top side of the stationary wall 6*d*, which precipitation may could damage, discoloration, etc. at the stationary wall 6*d*.

Again, the front cover 14*a* is provided on its inner side with a reinforcement 41*a* which, although the modified shape, compared to the front cover 14, has the same function. A filler profile 18*a* is also provided on the underside of the external pivot beam 3. Although the design of the filler profile 18*a* is changed, compared to the filler profile 18 shown in FIG. 3A, the function is unchanged, namely closing the space between the front cover 14*a* and the double gutter profile 13. Further details are therefore not included.

It should be understood that, in an embodiment wherein the stationary wall 6*d* is not transparent, it is not necessary to mount the front cover 14*a* on the external pivot beam 3. After all, the front cover 14*a* is not visible in such an embodiment. However, the filler profile 18*a* must be made slightly wider such that it fits closely with the stationary wall 6*d* such that, seen from the inner side of the terrace canopy 1, the pivot beam 3 is finished almost without a visible opening between the pivot beam 3 and the stationary wall 6*d*.

FIG. 3C illustrates a third type of external pivot bar, where the pivot bar is intended to form a sidewall 6. Identical elements will be indicated by the same numeral and are not described.

The pivot beam of FIG. 3C is designed to cooperate with a movable wall 5B, 5C (see FIGS. 2E and 2F). The main difference with the pivot beam of FIG. 3A is the presence of a wall holder profile 20 which is positioned outwardly with respect to the front cover 14', which therefore also has a modified shape, in particular the same shape as the front cover 14*a* described in a stationary wall infill with reference to FIG. 3B, such that a further description is not included here. It should be noted, however, that the front cover 14' is located at a different distance from the upright wall 100 of the base profile 12 compared to the front cover 14*a* of the pivot beam 3 shown in FIG. 3B. The design of the cover profile 15*a* has also been changed. In particular, the horizontal wall 400*a* has a longer length such that the distance between the pins 403, 404 is larger and such that the outer upright wall 402 is at a larger distance from the upright wall 100 of the base profile 12. This longer length allows to integrate the wall holder profile 20 into the design of the pivot beam 3 without adversely affecting the quality of the finish.

The wall holder profile 20 includes a guide chamber 480 which is identical to that of wall holder profiles 21, 21*a* and 21*b*. The guide chamber 480 is therefore limited by inner and outer upright walls 481, 482, an top horizontal wall 483 connecting the upright walls 481, 482, and a bottom wall 485 having an opening 496 therein. The upright walls 481, 482 together form a rail 484 into which one or more rollers (not shown) can be movably arranged. A portion of the rollers and/or the wall extends through the opening 496.

The bottom wall 485 comprises on its inwardly facing side a slot 490 for receiving the end 37' of the front cover 14' for the attachment of the front cover 14' to the wall holder profile 20. This slot 490 is in the particularly formed by a downwardly extending branch 499 that departs from the underside of the bottom wall 485. At the inner end of the bottom wall 485 it merges into an upright wall 486 which is provided almost in the middle with a bend 497 such that a lower portion of wall 486 is located more inwardly of an upper portion thereof. The upright wall 486, in particular the lower part thereof, is provided on its inner side with a first inner connection means 487, in particular a hooking means. The first inner connection means 487 serves to cooperate with the lower connection means 112 (see FIG. 5A) for connecting the wall holder profile 20 to the base profile 12. The bend 497 allows the upper part of the wall 486 to be positioned more outwardly and abuts against the branch 114. At the top of the upright wall 486, it merges into an top horizontal wall 488. Also, the top wall 483 of the guide chamber 480 is connected to this top wall 488 by support member 495. The horizontal wall 488 is provided at its inner end with a second inner connection means 489, in particular a hooking means, which hooks over the second top connection means 113 for connecting the wall holder profile 20 to the base profile 12.

The outer wall 481 of the guide chamber 480 also has an upward upright branch 492 which is provided on its upper side with an top connection means 491, in particular a female pin connection means. As shown in FIG. 3C, the top connection means 491 is used to connect the cover profile 15*a* via pin 404. A connecting wall 494 is provided between the horizontal wall 488 and the upright branch 492 for the strength and bearing capacity of the wall holder profile 20. A branch 493 is also provided on the outer side of the upright branch 492. The bottom wall 485 is provided on its outwardly facing side with an upright finishing wall 498 which is in the same plane as the outer wall 402 of the cover profile 15*a*. An opening 33*a* is provided between walls 402, 498.

Considering the presence of only one rail 484 in the external pivot beam of FIG. 3C, this means that only two types of movable wall 5B, 5C are possible. The purpose of this rail 484 is to hold a foldable side wall as shown in FIGS. 2E and 2F. However, a single rail 484 can also be used to hold one or two sliding side wall panels.

FIG. 3D illustrates a fourth type of external pivot bar, wherein the pivot bar is intended to form a side wall 6. Identical elements will be indicated by the same numeral and will not be described.

The pivot bar shown in FIG. 3D has a combined functionality, namely that of the pivot bars shown in FIGS. 3B and 3C. In other words, the external pivot beam 3 has, as side wall infill 6, both a part with a stationary wall 6*d* and a part with a movable, in particular a foldable, side wall 5C. For example, a stationary wall 6*d* is provided on one side of one side of the terrace canopy 1, while a foldable side wall 5C is present on the other side of the same side.

The front cover 14*a* and the drip profile 24 of the pivot bar of FIG. 3D are identical to those described with reference to FIG. 3B, and the cover profile 15*a* is identical to that described for the pivot bar of FIG. 3C. A further description is therefore not included here. In addition, the wall holder profile 20*a* is substantially identical to that described with reference to FIG. 3C. The only difference is the absence of branch 499 which served as attachment for the front cover 14*a*. This branch 499 is now not necessary since the front cover 14*a* is held by the drip profile 24 and is closer to the upright wall 100 of the base profile 12 such that there is sufficient space for placing a stationary wall 6*d*.

FIG. 4 illustrates a design of a tension beam 5. The tension beam 5 is intended not to be provided with a wall infill 6. The tension beam 5 comprises a base profile 12" and a single gutter profile 11 that are connected to each other. The single gutter profile 11 is also shown per se in FIG. 5C.

The tension beam 5 shown is generally the same as the pivot beam shown in FIG. 3A but with a different type of gutter profile, namely a single gutter profile 11 instead of a double gutter profile 13. Although the profiles 12", 14", 16", 18" of the tension beam 5 have a slightly different design, it should be clear that they are interchangeable with the profiles 12, 14, 16, 18 described above. It is also possible to replace one or more of the profiles 12, 14, 16, 18 in the external pivot beams 3 described above with its modified form of the same profile shown in the tension beam 5 of FIG. 4. Some of the modifications are briefly described. Notch 110 is not provided in the base profile 12", but this functionality is taken over by hook 108" which protrudes downwardly with respect to the horizontal wall 101". The branch 415" on connection profile 16" has been modified accordingly. The inner upright wall 432" of filler profile 18" is shorter and is directly connected to the upright outer side wall 441*a* of the end profile 19*a* instead of on the gutter profile. The design of the slot 42" has been changed.

Figure 5C:
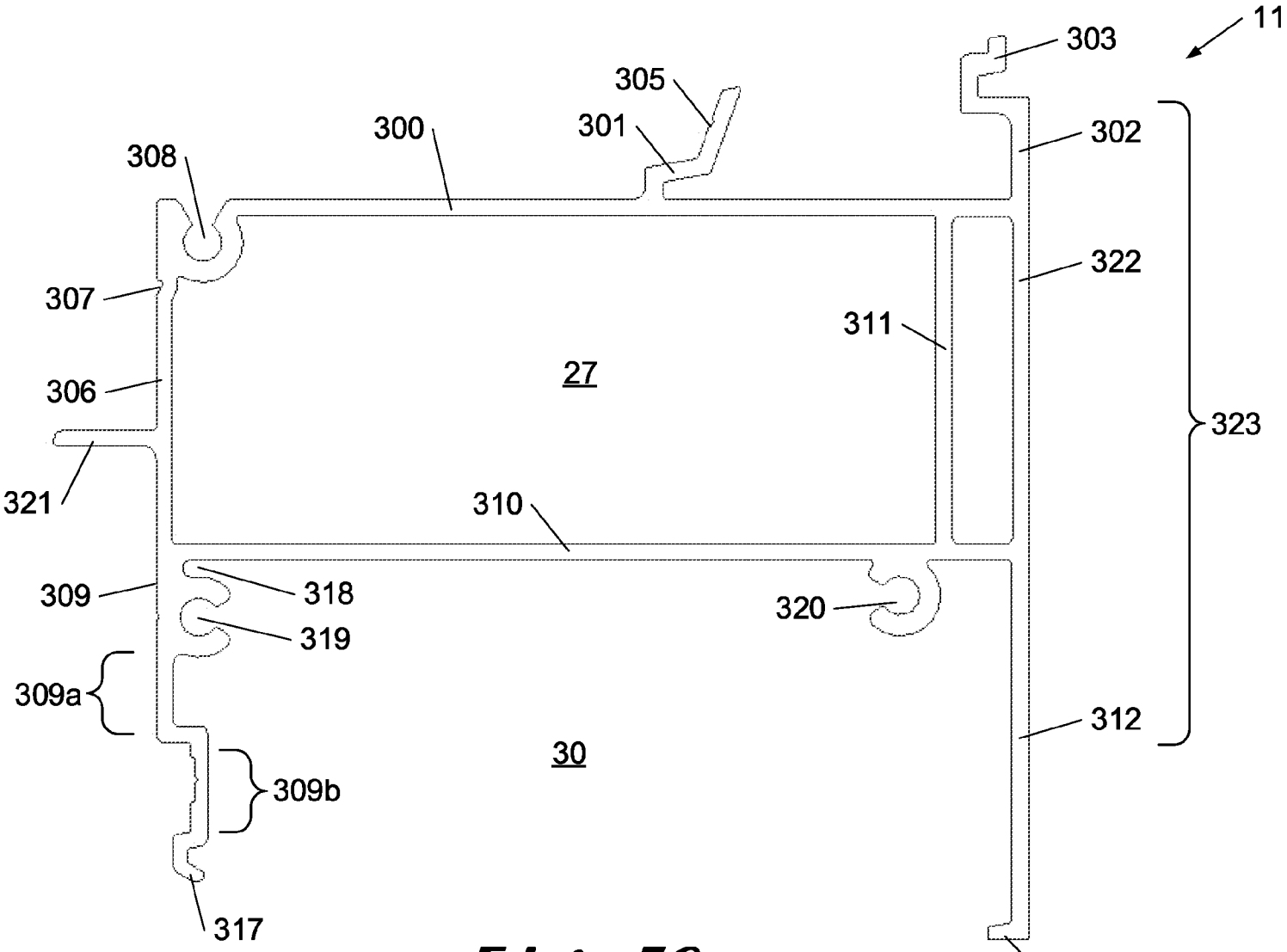

The single gutter profile 11 is shown in more detail in FIG. 5C. In view of the many similarities with the double gutter profile 13, it was decided to use the same numbering, but with the first digit "2" replaced by the digit "3". In concrete terms, the design at the top and the outer side of the gutter profiles 11, 13 is identical, such that a further description of elements 300 to 312 and 317 to 321 is superfluous.

The modifications of the single gutter profile 11 compared to the double gutter profile 13 are therefore located on the inner side of this profile, where now no external gutter 28 is present. An additional upright wall part 322 is therefore placed, which is parallel to the intermediate wall 311 (which, for the sake of clarity, in the embodiment of a single gutter profile, is not provided with openings). In this way, the upright walls 302, 312, 322 together form the inner upright wall 323 of the single gutter profile 11. This is also the externally visible wall, seen by someone located below the terrace canopy 1. Furthermore, the lower inner connection means 316, particularly a hooking means, is also substantially identical to connection means 216, with the difference that the hook only extends outwardly such that the finish of wall 323 is uninterrupted.

Although only an embodiment of a tension beam 5 has been shown, it is clear that the only difference between an external pivot beam 3 and a tension beam 5 is the shape of the gutter profile 11, 13. Hence, the invention also relates to multiple tension beams having the same functionality of the external pivot beams shown in FIGS. 3A to 3D where the double gutter profile 13 is replaceable by the single gutter profile 11 of FIG. 5C.

Just as the beams 3, 5 are adapted to the functionality of the wall infill 6, the columns 2 of the terrace canopy 1 are also adapted to it. A number of alternative embodiments of the columns 2 will be described hereafter with reference to FIGS. 7A to 7D, which show a cross-sectional view through the column 2.

The column 2 comprises an integrally formed core portion (generally indicated by reference numeral 70). In particular, the core part 70 is formed by a profile of the same or a similar type as the profiles 10, . . . , 24 of the beams 3, 5. The profile 70 is typically manufactured of a rigid material. This can be aluminium, for example. Aluminium has many advantages as a profile material, namely, it is at the same time robust and light-weighted. However, other materials, such as steel, stainless steel, wood, plastic, etc., are also suitable and their advantages or disadvantages are assumed to be known by the skilled person. A profile can be produced using various techniques depending on the material, including extrusion, cutting, setting, casting, welding, etc., with extrusion being the preferred technique. The appropriate production technique is assumed to be known by the skilled person. Preferably, the profile 70 is extruded from aluminium.

The profile 70 serves as a support pillar for the terrace canopy 1. In particular, almost the entire weight of the beams 3, 4, 5, and the elements connected therewith, such as the side walls 6 of the roof covering 7, is supported by the support pillar 70.

In the embodiments shown, the core profile 70 has a substantially square shape. Hence, each core profile 70 has four side walls 71, each having an outside 72 and an inside 73. Each outside 73 is provided with two mounting means 77, in particular mounting slots, preferably female pin connection means. These slots 77 serve for the attachment of finishing profiles 78 by means of a corresponding connection means 79, preferably a pin. It should be understood that the pin connection 79 is only one example of a way of attaching the finishing profiles 78 to the core profile 70 and other ways are known to the skilled person. It should also be understood that the slots 77 need not necessarily be continuous, although this is preferred since the core portion 70 is preferably made by an extrusion process. The slots 77 are symmetrically positioned with respect to the centre of a side wall 71, such that the attachment points of a finishing profile 78 to the side wall 71 are also symmetrical, which is advantageous.

Although the use of two mounting means 77 per side wall 71 is preferred, in view of the fact that the use of two separate attachments between two profiles allows for less clearance in the mutual positioning, which clearance may give rise to a divergent positioning, in particular by wind loads and/or precipitation loads, a connection with only one mounting means per side wall is also possible. On the other hand, more than two mounting means may also be provided per side wall.

As shown in FIG. 6, the walls 71 are also provided with a number of notches 80, 31, 98 on their outside. In particular, a notch 80 is provided centrally. Furthermore, each side wall 71 is provided near a vertex thereof with a first notch 31 closest to an application slot 77 and a second notch 98 nearer to the vertex.

It should be understood that the core profile 70, as described above, is not limited to a substantially square shape. Also, the four side walls 71 can be arranged in a different geometric shape, for example a rectangle or parallelogram. In addition, it is also possible to provide more or less side walls 71 per core profile 70, in particular tri-, hexa- or octagonal core profiles 70 are also possible. Furthermore, the core profile 70 may also be elliptical, in particular circular, in which case the desired number of application slots is then provided in the one continuous side wall comprising the core profile 70.

The functionality of the column 2 is determined solely by the finishing profiles 78. In other words, for each column 2 the core profile 70 is identical, as can be seen from FIGS. 6A to 6D.

Figure 6A:
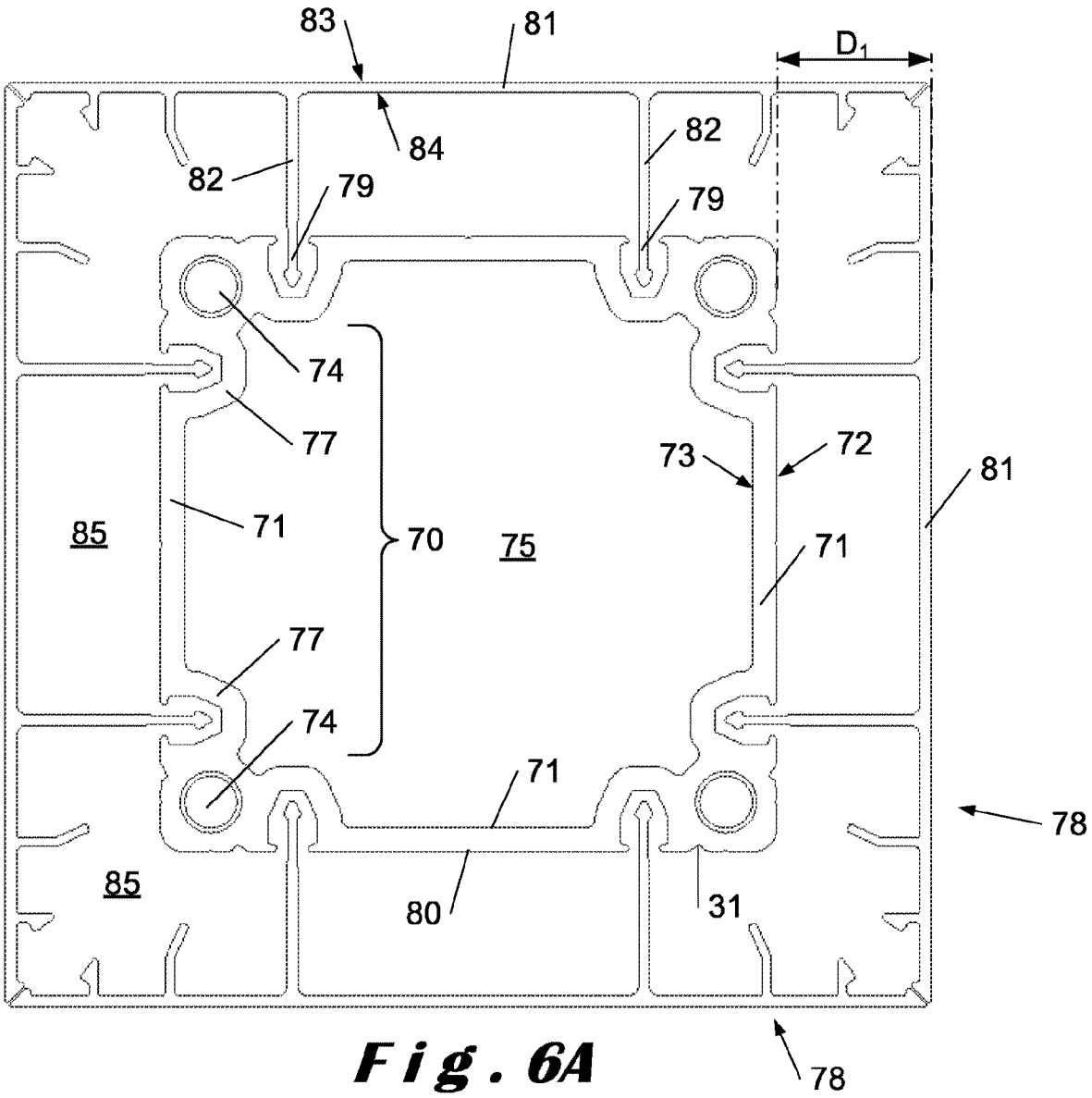
FIGS. 6A to 6D each show a cross-section through an alternative embodiment of a column with different functionality for wall infills.
Figure 6B:
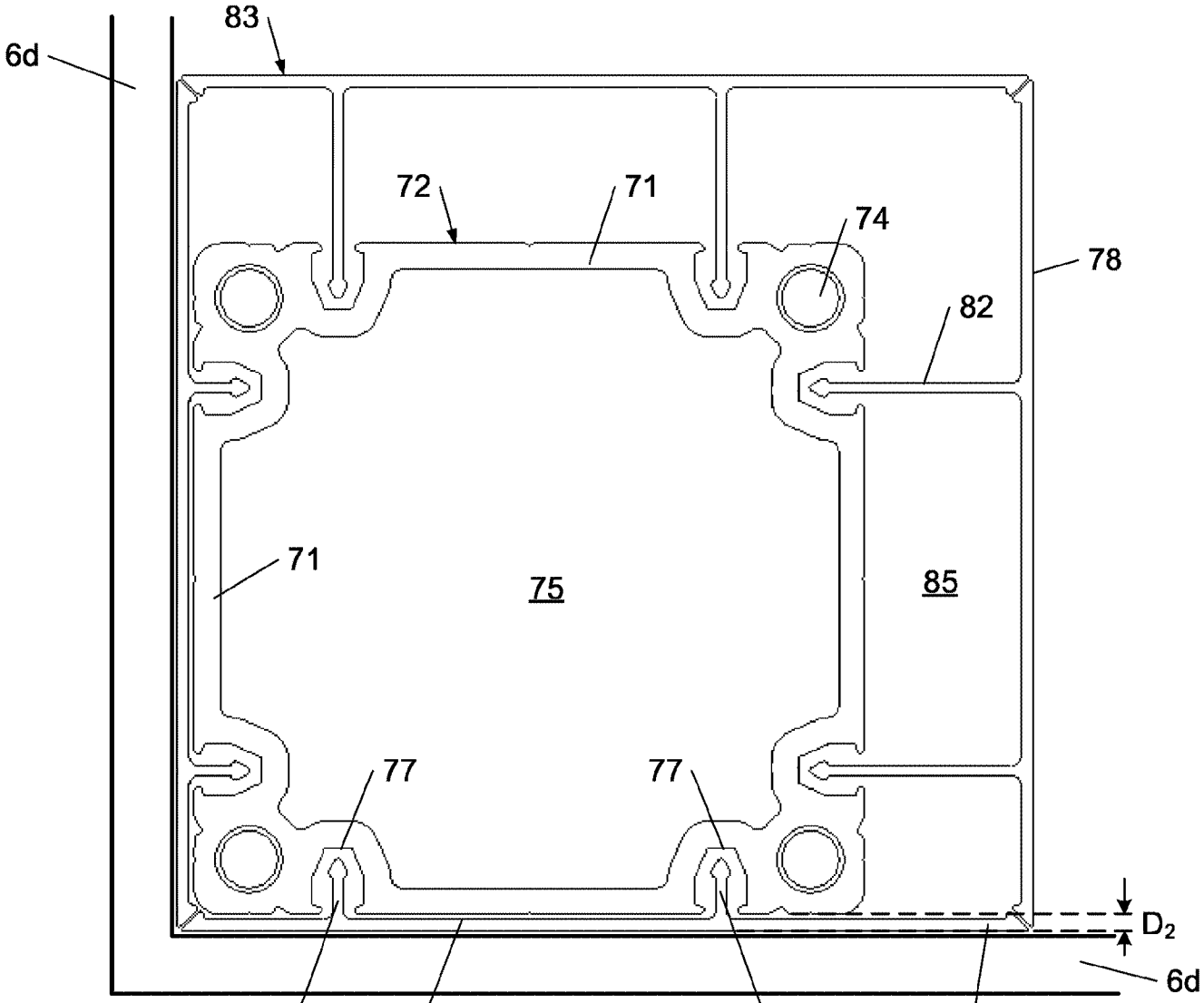

FIG. 6A illustrates a first design of a column 2 for use in a terrace canopy 1 without a wall infill. This column 2 is therefore suitable to be used together with the external pivot beam 3 of FIG. 3A and/or with the tension beam 5 of FIG. 4. The column 2 is provided with four finishing profiles 78, namely one on each side wall 71. Each finishing profile 78 is provided with a flat outer wall 81, the outside 83 of which determines the visual appearance of the column 2. In other words, the finishing profile 78 hides the core profile 70 in the built-up terrace canopy 1. Furthermore, each finishing profile 78 is provided with pins 79, namely one pin per mounting slot 77. The pins 79 are connected to the outer wall 81 by means of walls 82 that serve as spacer. In particular, the length of the walls 82 determines the distance (D1 as indicated in FIG. 6A and D2 as indicated in FIG. 6B) between the outside 72 of a wall 71 and the inside 84 of the outside wall 81. By providing spacers 82, cavities 85 are also created. One or more of these cavities 85 may be used for the integration of electrical cables that serve to drive the wall infill 6, the roof infill 7 and/or other electrically driven elements present in the terrace canopy 1.

The value of the distances D1, D2 are selected such that the outer side 83 of a finishing profile 78 lies in the same plane as the outer side of the front cover 14, 14*a* of the beams 3, 5. In other words, the distances d1, d2, D1 and D2 are chosen as a function of each other, whereby d1 and D1 are larger than the respective ones of d2 and D2, since these distances are intended for a terrace canopy 1 with a stationary wall infill 6*d*. In this way, all walls that form the outer side of the terrace canopy 1 are in the same plane, which is desired.

FIG. 6B illustrates a second design of a column 2 for use with a stationary wall infill 6*d* that continues along a vertex of the terrace canopy 1 and thus forms at least a partial infill of two side walls (see FIGS. 2H to 2J). Therefore, the column 2 is suitable to be used together with the external pivot beam 3 of FIGS. 3B and/or 3D and/or with a tension beam 5 having such functionality.

Figure 6C:
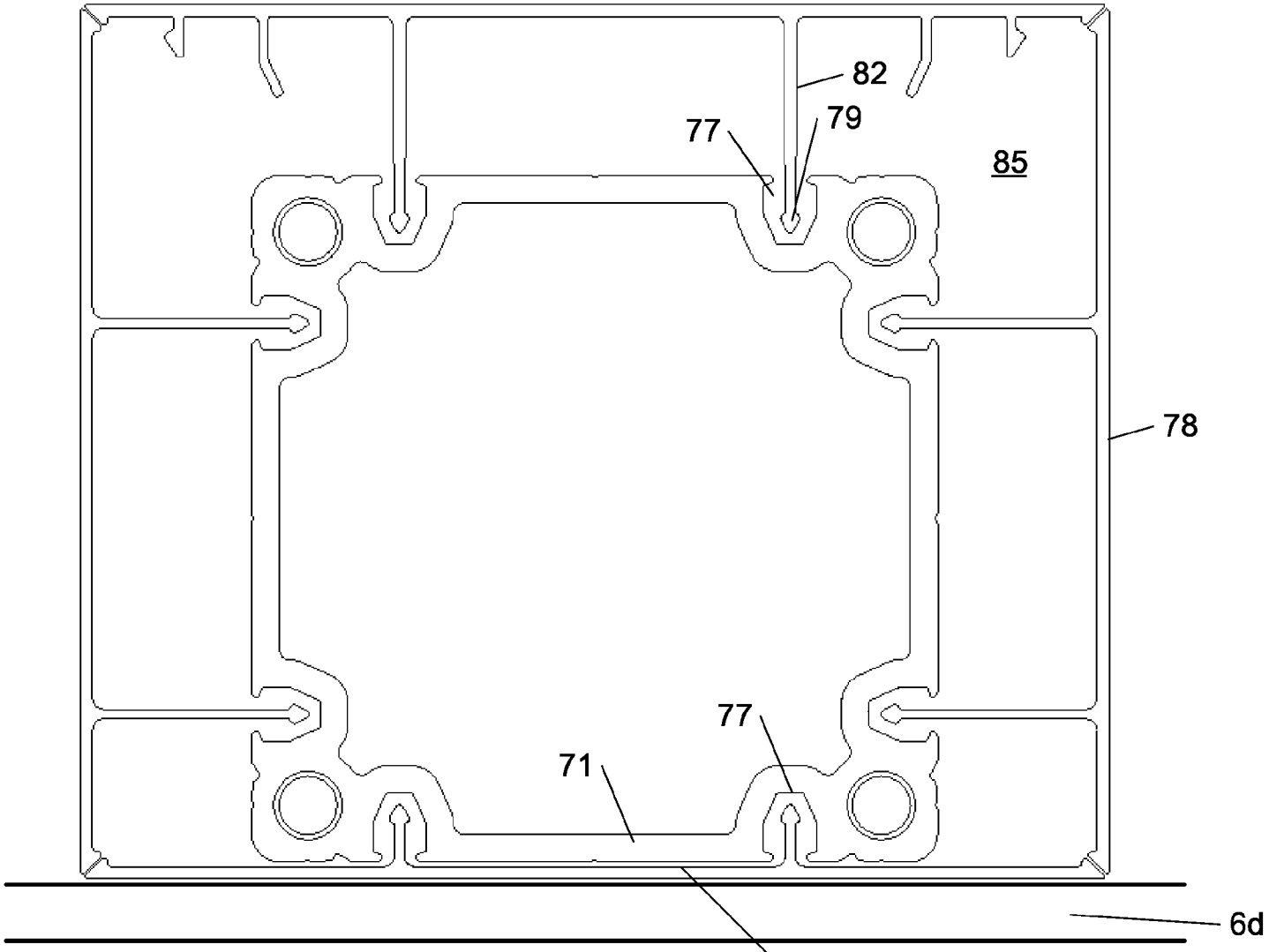

The main difference with the column of FIG. 6A is that, for two side walls 71, use is made of a finishing profile 78*a* without spacers 82. Hence, the outer side 83 of the finishing profile 78*a* is closer to the wall 71 than the outer side 83 of the finishing profile 78. In such a way, it is possible to provide a stationary side wall 6*d* below the beam 3, 5 of the terrace canopy 1, which continues along a column 2. In the case of the stationary side wall 6*d* is not transparent, the finishing profiles 78*a* between the side wall 6*d* and the core profile 70 may also be omitted since they are not visible anyway FIG. 6C illustrates a third design of a column 2 for use with a stationary wall 6*d* infill in which the column 2 is located in a side wall of the terrace canopy, but is not a vertex. In such an embodiment, it is only required that on one side, namely the outwardly facing side of the column 2, space is provided for the stationary side wall 6*d*. Hence, one finishing profile 78*a* is provided without spacers 82. Also, this finishing profile may also be omitted if the side wall 6*d* is not transparent.

Figure 6D:
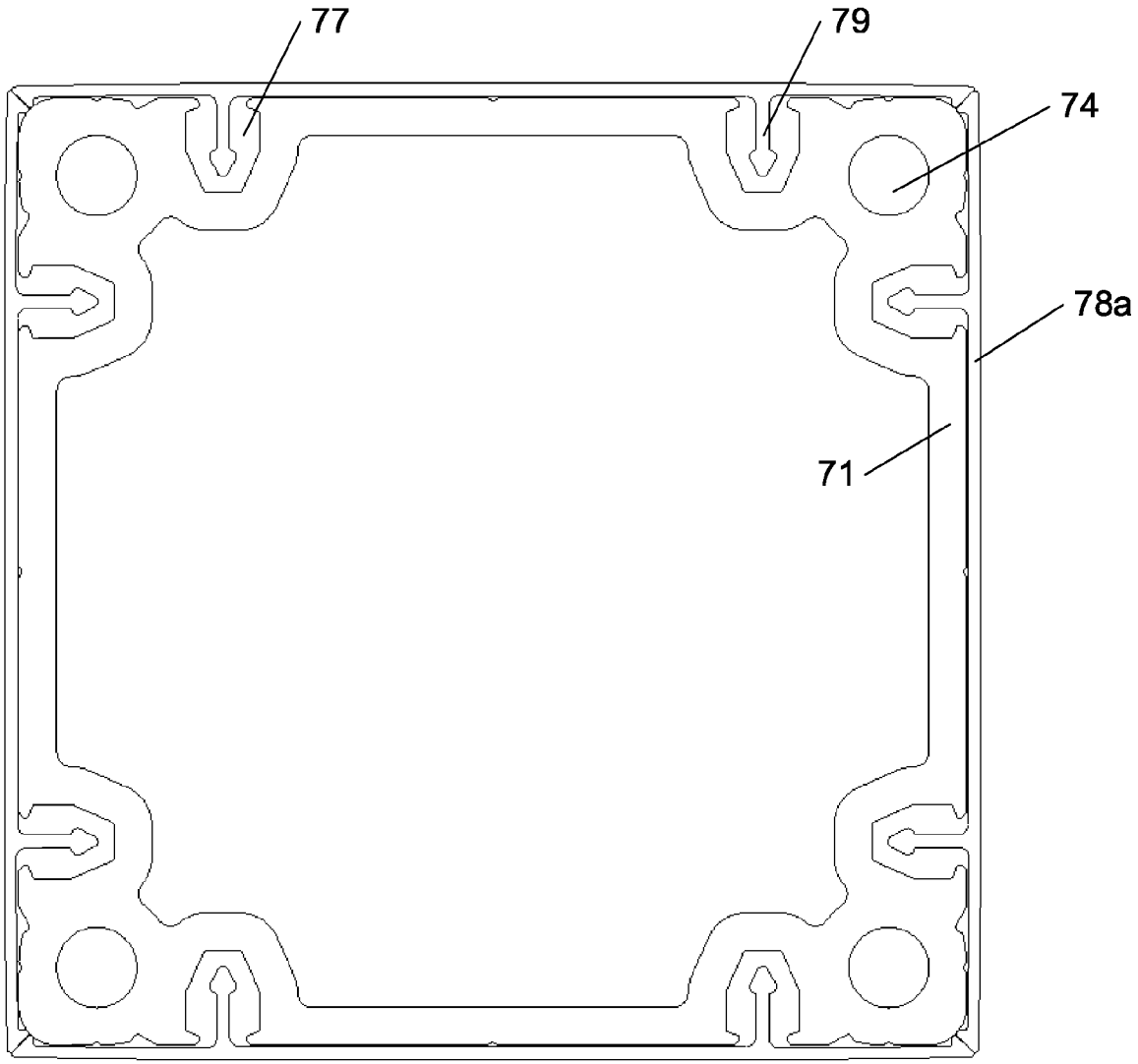

FIG. 6D illustrates a fourth design of a column 2 in which none of the finishing profiles 78*a* is provided with a spacer 82. This embodiment has the advantage that the space occupied by a column 2 is minimized such that the available space below the terrace canopy 1 is maximized.

While certain aspects of the present invention have been described with respect to specific embodiments, it is understood that these aspects may be implemented in other forms within the scope as defined by the claims.

The invention claimed is:

1. A set of profiles for constructing terrace canopy comprising a beam extending in a longitudinal direction and having a top side, a bottom side, an inner side and an outer side, wherein a height direction of the beam extends between the top side and the bottom side and a width direction of the beam extends between the inner side and the outer side, and wherein the set of profiles comprises:

a beam profile having an upright inner side wall and a first connection means, a first spacer profile provided with a second connection means and a third connection means;

a second spacer profile different from the first spacer profile and provided with a second connection means and a fourth connection means, the second connection means of the first space profile and the second spacer profile being identical;

a first beam-finishing profile; and a second beam-finishing profile, wherein a first beam can be constructed of at least the beam profile, the first spacer profile and the first beam-finishing profile so that the first spacer profile is attached to the beam profile by the first and second connection means and the first beam-finishing profile is connected to the first spacer profile by the third connection means, wherein a second beam can be constructed of at least the beam profile, the second spacer profile and the second beam-finishing profile, so that the second spacer profile is attached to the beam profile by the first and second connection means and the second beam-finishing profile is connected to the second space profile by the fourth connection means, and wherein the first beam-finishing profile has an outwardly facing surface located at a first distance from the upright inner side wall and the second beam-finishing profile has an outwardly facing surface located at a second distance from the upright inner side wall, the first distance and the second being measured in a direction parallel to the width direction of the beam, wherein the first distance and the second distance are different.

2. The set of profiles according to claim 1, wherein the first connection means is connected to the upright wall by means of a horizontal top wall.

3. The set of profiles according to claim 1, wherein the first beam-finishing profile comprises a fifth connection means, in particular a pin, configured to cooperate with the third connection means.

4. The set of profiles according to claim 1, wherein the beam profile comprises a sixth connection means, in particular a slot, and that the first beam-finishing profile comprises a seventh connection means, in particular formed by an end part of the first beam-finishing profile, configured to cooperate with the sixth connection means.

5. The set of profiles according to claim 1, wherein the second beam-finishing profile comprises an eighth connection means, in particular formed by an end part of the second beam-finishing profile, configured to cooperate with the fourth connection means.

6. The set of profiles according to claim 1, wherein the second spacer profile is formed by a drip profile.

7. The set of profiles according to claim 1, wherein the second spacer profile is formed by a wall holder profile.

8. The set of profiles according to claim 1, wherein the first spacer profile is formed by a connection profile.

9. The set of profiles according to claim 1, wherein the first connection means comprises at least one hook and/or the second connection means comprises at least one hook and/or the third connection means comprises a female pin connection element and/or the fourth connection means comprises a slot.

10. The set of profiles according to claim 1, wherein the set further comprises:

a support profile provided to serve as a support pillar of the terrace canopy;

at least one first support-finishing profile attachable to a side of the support profile, the first support-finishing profile having an outwardly facing surface which, when the first support-finishing profile is attached to the support profile, is located at a third distance from the side; and a second support-finishing profile attachable to the side of the support profile, the second support-finishing profile having an outwardly facing surface which, when the second support-finishing profile is attached to the support profile, is located at a fourth distance from the side, the third and fourth distances being different.

11. The set of profiles according to claim 10, wherein the outwardly facing surfaces of the first support-finishing profile and the first beam-finishing profile are located substantially in the same first plane and wherein the outwardly facing surfaces of the second support-finishing profile and the second beam-finishing profile are located substantially in the same second plane.

12. The set of profiles according to claim 11, wherein the first and second planes are different.

13. The set of profiles according to claim 1, wherein the first beam-finishing profile and the second beam-finishing profile are different.

14. The set of profiles according to claim 1, wherein the first spacer profile and the first beam-finishing profile are removable from the beam profile and can be replaced with the second spacer profile and the second beam-finishing profile to change from a first configuration of a beam to the second configuration thereof and vice versa.

15. A set of profiles for constructing terrace canopy comprising a beam extending in a longitudinal direction and having a top side, a bottom side, an inner side and an outer side, wherein a height direction of the beam extends between the top side and the bottom side and a width direction of the beam extends between the inner side and the outer side, and wherein the set comprises:

a beam profile having an upright inner side wall and a first connection, a first spacer profile provided with a second connection and a third connection;

a second spacer profile different from the first spacer profile and provided with a second connection and a fourth connection, the second connection of the first space profile and the second spacer profile being identical;

a first beam-finishing profile; and a second beam-finishing profile, wherein a first beam can be constructed of at least the beam profile, the first spacer profile and the first beam-finishing profile so that the first spacer profile is attached to the beam profile by the first and second connection and the first beam-finishing profile is connected to the first spacer profile by the third connection, wherein a second beam can be constructed of at least the beam profile, the second spacer profile and the second beam-finishing profile so that the second spacer profile is attached to the beam profile by the first and second connection and the second beam-finishing profile is connected to the second space profile by the fourth connection, and wherein the first beam-finishing profile has an outwardly facing surface located at a first distance from the upright inner side wall and the second beam-finishing profile has an outwardly facing surface located at a second distance from the upright inner side wall, the first distance and the second being measured in a direction parallel to the width direction of the beam, wherein the first distance and the second distance are different.

16. The set of profiles according to claim 15, wherein the first connection is connected to the upright wall by of a horizontal top wall.

17. The set of profiles according to claim 15, wherein the first beam-finishing profile comprises a fifth connection, in particular a pin, configured to cooperate with the third connection.

18. The set of profiles according to claim 15, wherein the beam profile comprises a sixth connection, in particular a slot, and that the first beam-finishing profile comprises a seventh connection, in particular formed by an end part of the first beam-finishing profile, configured to cooperate with the sixth connection.

19. The set of profiles according to claim 15, wherein the second beam-finishing profile comprises an eighth connection, in particular formed by an end part of the second beam-finishing profile, configured to cooperate with the fourth connection.

20. The set of profiles according to claim 15, wherein the second spacer profile is formed by a drip profile.

* * * * *